US011629023B2

(12) United States Patent
Bertolucci et al.

(10) Patent No.: US 11,629,023 B2
(45) Date of Patent: Apr. 18, 2023

(54) METHOD FOR PERFORMING MEASUREMENTS OF LOGS IN A PRODUCTION LINE AND PRODUCTION LINE FOR IMPLEMENTING THE METHOD

(71) Applicant: FABIO PERINI S.P.A., Lucca (IT)

(72) Inventors: Remo Bertolucci, Lucca (IT); Mauro Rocca, Lucca (IT); Davide Ghiselli, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 395 days.

(21) Appl. No.: 17/041,579

(22) PCT Filed: Mar. 21, 2019

(86) PCT No.: PCT/EP2019/057043
§ 371 (c)(1),
(2) Date: Sep. 25, 2020

(87) PCT Pub. No.: WO2019/185438
PCT Pub. Date: Oct. 3, 2019

(65) Prior Publication Data

US 2021/0039908 A1 Feb. 11, 2021

(30) Foreign Application Priority Data

Mar. 26, 2018 (IT) ..... 102018000003969

(51) Int. Cl.
*B65H 19/30* (2006.01)
*B65H 19/22* (2006.01)

(52) U.S. Cl.
CPC ..... *B65H 19/2269* (2013.01); *B65H 19/30* (2013.01); *B65H 2301/41447* (2013.01);
(Continued)

(58) Field of Classification Search
CPC ..... B65H 19/30; B65H 19/2269; B65H 2301/448; B65H 2301/5421; B65H 2515/84; B65H 2553/42; B65H 2553/61
See application file for complete search history.

(56) References Cited

U.S. PATENT DOCUMENTS 6,053,304 A * 4/2000 Biagiotti ..... B65G 47/5122 198/794
7,127,951 B2 * 10/2006 Sartain ..... B65H 26/00 73/818

(Continued)

FOREIGN PATENT DOCUMENTS

CN 102942019 B 12/2014
CN 104180882 A 12/2014

(Continued)

*Primary Examiner* — Sang K Kim
(74) *Attorney, Agent, or Firm* — Breiner & Breiner, L.L.C.

(57) ABSTRACT

A line is disclosed for producing logs of web material provided with a system for controlling, in real time, one or more parameters of the logs produced by the line and for facilitating any corrective actions. The line includes a rewinder, a feed path for the logs from the rewinder towards at least one station arranged downstream of the rewinder; and a measurement station. The measurement station includes at least a measurement device for measuring at least one parameter of logs randomly selected from the feed path and held in the measurement station, for example a device for measuring the firmness of the logs. The measurement station further includes first transferring members for transferring selected logs from the feed path to the measurement station, and second transferring members for transferring selected logs from the measurement station to the feed path.

33 Claims, 17 Drawing Sheets

(52) U.S. Cl.
CPC ..... *B65H 2301/448* (2013.01); *B65H 2301/5421* (2013.01); *B65H 2515/84* (2013.01); *B65H 2553/42* (2013.01); *B65H 2553/61* (2013.01)

(56) References Cited

U.S. PATENT DOCUMENTS

| | | | | |
|---|---|---|---|---|
| 7,204,154 | B2 * | 4/2007 | Sartain | G01N 3/40 73/818 |
| 9,132,962 | B2 | 9/2015 | Cicalini et al. | |
| 2003/0231318 | A1 | 12/2003 | Sartain et al. | |
| 2005/0097966 | A1 * | 5/2005 | Sartain | B65H 26/00 73/818 |
| 2007/0012119 | A1 * | 1/2007 | Sartain | G01N 33/34 73/818 |

FOREIGN PATENT DOCUMENTS

| | | | |
|---|---|---|---|
| CN | 105234089 | B | 9/2017 |
| EP | 1063190 | A2 | 12/2000 |
| EP | 1530044 | A1 | 5/2005 |
| JP | H11116112 | A | 4/1999 |
| WO | 2016098135 | A1 | 6/2016 |

* cited by examiner

METHOD FOR PERFORMING MEASUREMENTS OF LOGS IN A PRODUCTION LINE AND PRODUCTION LINE FOR IMPLEMENTING THE METHOD

TECHNICAL FIELD

The present invention relates to improvements to methods and lines for producing logs of wound web material. Embodiments disclosed herein especially relate to methods and lines for tissue paper converting and for producing tissue paper logs.

STATE OF THE ART

Tissue paper is used for producing many articles for home, professional, as well as industrial use. In particular, tissue paper is often used in the form of logs of toilet paper, kitchen towels and the like.

The tissue paper logs are produced from tissue paper reels of large diameter, the so-called parent reels. One or more parent reels are unwound to feed one or more plies of tissue paper to a rewinder, which forms logs of axial length equal to the axial length of the parent reels, and diameter equal to the diameter of the finished product destined for consumption. The tissue paper plies coming from the reels are bonded together to form a web material, which is wound in logs in a winding cradle.

The winding cradle is typically comprised of a plurality of motorized winding rollers, combined, if necessary, with winding mandrels or tail stocks, for example in some cases when the logs are formed around tubular winding cores. The winding rollers are kept in rotation at suitable peripheral speeds and in surface contact with the log being formed, so as to transmit the log the torque necessary for winding it.

Then, the logs are subjected to a series of further processing, among which: sealing the tail end of the web material so that it does not hinder the subsequent production steps, cutting into small logs, whose axial dimension is equal to the axial dimension of the finished product destined to consumption, packaging.

In the winding step, given production parameters for the logs are set. A very important production parameter is the log firmness, i.e. the tendency of the log to be laterally squashed when subjected to a localized pressure on the side cylindrical surface thereof. Among other things, firmness is also affected by the winding tension, i.e. the tension to which the continuous web of tissue paper is subjected while it is wound.

The firmness of the log is also linked to the winding density, which is in turn linked to the amount of web material wound on each log per volume unit. The greater the density of the turns of web material, the greater the amount of wound paper, given the same outer diameter. A further important parameter in the log production is the weight of the single logs, which is indicative of the amount of paper wound on each log.

A further significant parameter for determining the log quality is the final diameter. The paper manufacturers usually define the diameter, the number of sheets, i.e. the number of perforations on the paper wound on each log, and therefore the length of the wound paper, as well as the firmness of the log. If one of these parameters does not meet the set target, it is necessary to act on the parameters of the production plant so that the logs, and therefore the final small rolls obtained by cutting the logs, have the desired quality.

A further parameter for determining the log quality is the analysis of the log surface profile by means of a profilometer, with which it is possible to analyze the embossing on the paper plies; in other words, the paper embossing depth is for example measured on at least part of the outer surface of the log. In this case again, if the embossing depth does not correspond to the set value, it is necessary to act on the production parameters of the paper converting line.

Various operating parameters of the production line can be controlled and modified in order to achieve the desired firmness, weight, or other desired parameters of the logs. Just by way of non-limiting example, the following can be adjusted to achieve the desired parameters: the tension of the web material; the embossing depth; the winding speed and winding time, and therefore the length of web material wound on each log; the difference in the peripheral speed of the winding rollers forming the winding cradle of the rewinder.

SUMMARY OF THE INVENTION

According to one aspect, a method is provided for producing logs of web material, wherein logs of web material are produced sequentially. The logs are fed along a feed path through a plurality of stations arranged along the feed path. The stations may comprise various machines, units, groups, members or elements, which perform one or more operations on the logs, for example sealing the final tail end thereof, accumulating them, feeding them to other processing members, cutting them into logs of smaller axial dimensions, etc.

Advantageously, production methods and production lines described herein carry out measurements on randomly selected logs, thus allowing to have useful information for controlling the winding, without excessively slowing down the speed of the production line.

To this end, according to a possible approach, the logs selected to be measured are deviated from the feed path and are then inserted again in the feed path. The logs can be taken from the feed path and inserted therein again automatically, by means of suitable deviating members.

In some embodiments, a method is therefore provided for producing logs of web material, comprising the following steps: sequentially winding a plurality of logs of web material; feeding the logs along a feed path, preferably between a rewinder and a severing machine that cuts the logs into small logs; randomly taking single logs from the feed path; transferring the logs taken from the feed path to a measurement station associated with the feed path but outside it; measuring at least one parameter of the logs transferred to the measurement station; inserting the logs from the measurement station again in the feed path, preferably upstream of the severing machine.

In this way, the logs can be randomly checked. While a log is automatically transferred to the measurement station and then inserted again in the feed path towards the severing machine, the logs that have been produced in the meanwhile follow the normal feed path from the rewinder to the severing machine, without being delayed or slowed down.

In other embodiments, to measure randomly selected logs without slowing down the production of the line, it is possible to proceed substantially in the opposite way, by deviating the path of the logs not subjected to measurement, while the measurement station is arranged along the normal feed path and is occasionally occupied for a random measurement. For example, while a log is in the measurement step, the logs that move forwards along the line (and which does not require to be measured) can be deviated towards a temporary accumulator, which can have entrance and exit upstream of the measurement station, or which may constitute a path by-passing the measurement station, having in this case an entrance upstream of the measurement station and an exit downstream of the measurement station with respect to the feed direction of the logs along the feed path.

Therefore, in some embodiments a method is provided having the following steps: sequentially winding a plurality of logs of web material; sequentially winding a plurality of logs of web material; stopping randomly selected logs in the measurement station and measuring at least one parameter thereof in said measurement station; after measurement, continuing to feed the logs from the measurement station along the feed path, for example towards a severing machine; while a log is in the measurement station and said at least one measurement is performed, deviating subsequent logs from the feed path along a deviation path.

The deviation path may be a path bypassing the measurement station, or a path where logs are temporarily accumulated upstream of the measurement station.

According to embodiments described herein, the method provides for the step of randomly taking single logs from the feed path and transferring each log taken from the feed path to a measurement station arranged outside the feed path. In the measurement station, one or more parameters of the log are measured, for example to verify that they correspond to preset values. The logs can be randomly taken or can be taken under the manual control of an operator. In some embodiments, the logs can be randomly taken at regular intervals, every X logs produced, where the number X can be fixed, variable or can be set, automatically or by an operator, according to various criteria. For example, the rate at which the logs are taken, i.e. the number of logs X between a taken log and the subsequent taken log, can be modified if deviations of the measured parameters are detected with respect to the preset parameters, so as to perform a more severe check.

For example, the rate at which the logs are taken can be set so that as soon as a log exits the measurement station, a new log enters in it, i.e. constantly suppling logs to the measurement station, but without creating queues of logs. This solution allows measuring a greater amount of logs moving along the feed path.

The logs can be taken from a path, along which they move forward in a direction substantially orthogonal to the longitudinal extension thereof, i.e. orthogonal to the winding axis. The path from which the logs are taken, and in which they can be inserted again after they have been measured, can be arranged between a rewinder, producing the logs, and a severing machine, cutting them into single rolls of smaller axial length. In this way, single logs, advantageously randomly taken, are measured before being cut into individual rolls in the severing machine.

The method may provide for the step of measuring at least one parameter of the log in the measurement station. The method may further provide that, after the measurement, the taken log is inserted again in the feed path.

The method described herein allows measuring logs taken from the feed path, which are then inserted again in the feed path. In this way, measurements can also be performed automatically, and the results thereof can be used to modify production parameters, i.e. operating parameters of the machines or stations upstream along the production line. In this way, it is possible automatically to control the production quality, with minimal labor impact, as well to efficiently, and possibly automatically, intervene on the production to correct any deviations from the set production parameters.

The measurements that can be performed on the taken log can be of various types. For example, it is possible to measure the diameter of the log. The diameter can be measured by means of optical systems such as cameras, or laser systems. Preferably, measurements of different type are also performed in the measurement station, for example the weight of the log can be measured. In some embodiments, instead of or in addition to weight and diameter, it is possible to measure the firmness of the log. Through further optical systems, such as lasers, it is possible to detect the embossing depth of at least the outer surface of the log.

In order to automate at least partially the production and the adjustment of the operating or production parameters, in some embodiments a programmable control unit can be provided, which detects the difference between at least one parameter measured on the log and a target value or a range of values around a target value. When a difference or discrepancy is detected, the control unit can be programmed so as to require one or more machines in the production line to correct an operating parameter, i.e. a production parameter. For example, if the measured density is lower than a predetermined or desired value, the control unit can control members of the rewinder so that the tension of the wound web material and/or the difference between the peripheral speeds of two or more winding rollers of the rewinder is increased.

In some embodiments, the control unit can also emit an alarm signal, for example to allow the operator to verify how the operating parameters are modified.

In further embodiments, the control unit can verify whether there are margins for the change or correction of one or more operating parameters, i.e. production parameters, of one or more machines of the line, in order to bring the measured parameter within a tolerance range. The control unit can be programmed to emit an alarm signal if the production parameters cannot be corrected, or if the values set for the production parameters are limit values, for example outside the normal operating range of the machines.

Just by way of example, it is possible to modify the embossing pressure or the non-parallelism between rollers of an embossing unit, in order to modify the overall embossing depth, or to modify how the embossing depth is distributed along the axis of the log. The control unit can emit an alarm signal to inform the operator when and if the embossing pressure, or the angle between the rotation axes of the rollers achieve limit values (in order to correct a discrepancy between the desired value and the measured value of the parameter of the logs), beyond which it is not appropriate to operate.

In advantageous embodiments, the logs to be measured can be automatically deviated from the feed path to a measurement path. The measurement path can comprise a lifting path, for lifting the taken logs towards the measurement station through an elevator. The measurement path can also comprise a path for inserting the logs into the feed path again.

The log removed from the feed path can be inserted again into the feed path by automatically discharging it from the measurement station towards the feed path, for example through gravity.

For randomly taking logs from the feed path the following steps can be provided: temporarily introducing an abutment in the feed path; stopping the log against the abutment; and removing from the feed path the log stopped against the abutment. The abutment may be part of an elevator adapted to lift the log stopped against the abutment towards the measurement station, which can advantageously be placed at a higher height than the normal feed path along the production line. In other embodiments, the measurement station can be arranged on a side of the feed path, or below the feed path of the production line.

Arranging the measurement station above the normal feed path, or ordinary feed path, followed by the logs that are not to be measured, is particularly advantageous. Compared to arranging the measurement station on a side of the production line and the feed path, arranging it over the feed path reduces the overall footprint. Furthermore, the logs can be taken from the ordinary feed path quicker.

Compared to arranging the measurement station under the ordinary feed path, arranging it the above the ordinary feed path makes the construction of the line and the measurement station much easier and the various machines more accessible. Furthermore, the measurement station is in a cleaner area, where there is less accumulation of debris, such as cellulose fiber dust. This is advantageous for the accuracy of the measurements.

The log taken for being measured can be inserted again into the normal feed path at a height above the height at which the log has been taken from the feed path. This is possible, for example, by providing that the measured logs are inserted into an accumulator downstream of the measurement station. The accumulator normally extends vertically, and has chains or other flexible members defining a conveyor having long vertical portions. The chains carry cradles or seats for receiving and transporting the logs. The measured logs can be inserted in these cradles at a high position along the vertical extension of the accumulator.

Preferably, the logs to be measured are taken after a step of sealing the tail thereof. In this way, an accidental unwinding of the web material forming the log can be avoided.

Preferably, the method described herein provides for the step of modifying at least one log production operating parameter according to the result of the measurements performed on the log.

According to a further aspect, a line is disclosed for producing logs of web material, comprising a rewinder, a feed path for the logs from the rewinder towards at least one station arranged downstream of the rewinder; a measurement station comprising at least one measurement device for measuring at least one parameter of logs randomly selected from the feed path and held in the measurement station; first transferring members for transferring selected logs from the feed path to the measurement station; and second transferring members for transferring selected logs from the measurement station to the feed path.

In embodiments described herein, for example in order to have a random control that does not slow down productivity, a log production line is specifically provided, comprising: a rewinder; a feed path for the logs from the rewinder to at least one station downstream of the rewinder, preferably comprising a severing machine; a measurement station comprising at least one measurement device for measuring at least one parameter of logs randomly selected from the feed path and held in the measurement station arranged outside the feed path; first transferring members for transferring selected logs from the feed path to the measurement station; second transferring members for transferring selected logs from the measurement station to the feed path, in particular upstream of the severing machine; wherein the first transferring members are adapted to take randomly selected logs from the feed path and to transfer them to the measurement station.

In other embodiments described herein, again in order to obtain a random control that does not slow down productivity, a line is in particular provided comprising: a rewinder; a feed path for the logs from the rewinder to at least one station downstream of the rewinder, preferably comprising a severing machine, along which feed path a measurement station is provided, comprising at least one measurement device for measuring at least one parameter of randomly taken logs; a temporary accumulation and/or deviation device for the logs fed along the feed path while a log is in the measurement station, said temporary accumulation device being adapted to temporarily store the logs until the measurement on the log in the measurement station is finished and/or to temporarily deviate the logs with respect to the measurement station and to insert them again in the feed path downstream of the measurement station temporarily occupied by the randomly taken log on which measurements are performed.

The line may comprise a tail sealing machine for sealing the tail of the logs, arranged along the feed path downstream of the rewinder. The first transfer members may be adapted to take the logs from the feed path downstream of the tail sealing machine.

The line can also comprise a log accumulator, downstream of the tail sealing machine. The second transferring members may be adapted to transfer the logs from the measurement station to the accumulator. Moreover, the feed path, along which the not measured logs, i.e. the logs not taken an deviated to the measurement station, move forwards, can extend between the tail sealing machine and the accumulator, passing for example under the measurement station.

The measurement station may comprise at least one device for measuring the weight of the logs, or at least one device for measuring the firmness of the logs, or a device for measuring the log diameter, or a device for measuring the embossing profile of the logs, or a combination of two or more of these devices.

In some embodiments, the first transferring members comprise an elevator, adapted to selectively take logs from the feed path and to transfer them to the measurement station. For example, the elevator may comprise movable abutments adapted to stop the logs to be taken along the feed path.

The second transferring members may comprise a chute adapted to make the logs roll from the measurement station to the feed path. The second transferring members may preferably comprise also a rotating distributor, which performs a time control of the transfer of the logs towards the accumulator.

The measurement station can have a seat for the logs, associated with the measurement device. The seat can comprise a cradle, for example a V-shaped cradle, to which load cells can be associated to measure the weight of the log.

Members for measuring the firmness of the log and the embossing depth, preferably arranged above the seat, as well as devices for measuring the diameter can be associated to the seat. In other configurations, the device for measuring the diameter, for example a camera, can be arranged transversely at a side of the seat so as to frame the edge of the log. In other configurations, two cameras can co-act for measuring the diameter, one arranged at a side and the other above the seat.

Further advantageous features and embodiments of the method and of the production line are described in the detailed description below of embodiments and in the attached claims, which form an integral part of the description.

BRIEF DESCRIPTION OF THE DRAWINGS

The invention will be better understood by following the description and the accompanying drawing, which shows a non-limiting example of embodiment of the invention. More in particular, in the drawing.

DETAILED DESCRIPTION OF EMBODIMENTS

Figure 1:
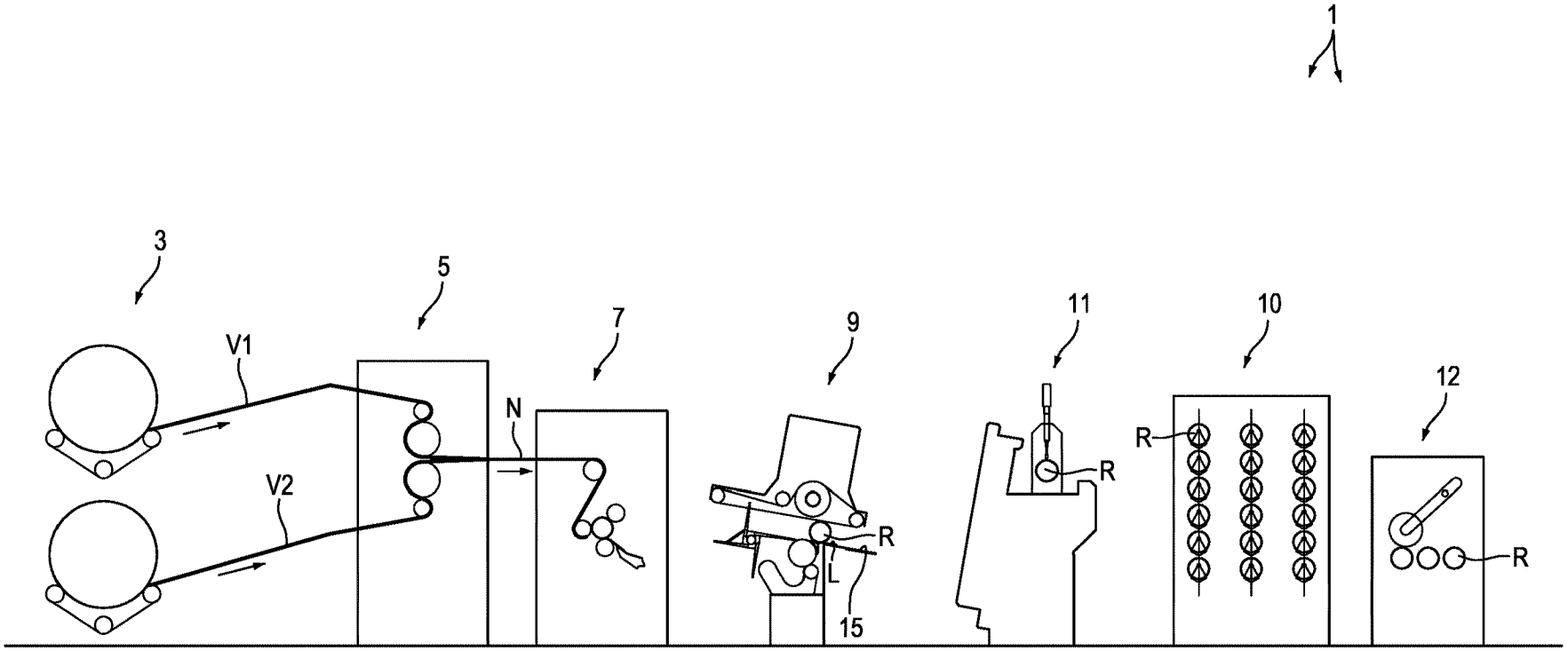
FIG. 1 is a diagram of a tissue paper processing line for producing logs.

The detailed description below of example embodiments is made with reference to the attached drawing. The same reference numbers in different figures identify equal or similar elements. Moreover, the drawings are not necessarily to scale. The detailed description below does not limit the invention. The protective scope of the present invention is defined by the attached claims.

In the description, the reference to "an embodiment", "the embodiment" or "some embodiments" means that a particular feature, structure or element described with reference to an embodiment is comprised in at least one embodiment of the described object. The sentences "in an embodiment" or "in the embodiment" or "in some embodiments" in the description do not therefore necessarily refer to the same embodiment or embodiments. The particular features, structures or elements can be furthermore combined in any adequate way in one or more embodiments.

As will be described in detail below with reference to the accompanying drawing, a line is disclosed for converting web material, for example and especially, but not exclusively, tissue paper, for producing logs. The line comprises various processing stations, for example an unwinding station, a rewinder, a tail sealing machine for sealing the tail of the single logs, and an accumulator. A measurement station is provided in a suitable position, for example between the rewinder and the accumulator, and preferably downstream of the tail sealing machine, for measuring one or more parameters of the produced logs. The information obtained from the sensors provided in the measurement station can be used to modify the operating parameters of one or more machines, stations, units or the like provided in the production line. For example, the measurement station can comprise means for measuring one or more of the following parameters: the weight of the log, the firmness of the log, the diameter of the log, the embossing depth. If the measurement detects that the log is outside a tolerance range around a set value, a control unit can act to change one or more parameters of the rewinder and/or of other units along the production line. If the one or more parameters cannot be changed, for example if it is necessary to increase the embossing depth beyond a maximum limit, or if a measure is significantly greater than or lower than a target value, the control unit can send an alarm signal to the operator.

The tolerance ranges can be selected suitably, for example according to the degree of accuracy and therefore to the desired quality of the final product. For example, the interval around a target value can be expressed as a percentage of deviation from the set target value. For example, the range can be comprised between +10% and −10% of the target value, that means that if the desired value (target) of the parameter is 100, measures of this parameter ranging from 90 to 110 fall within the allowable range. Preferably, the tolerance range can be between +5% and −5%, or between +2% and −2%, or between +1% and −1%. Tolerance ranges that are not symmetrical to the target value can also be used, for example +5% and −2%. In some cases, the tolerance can for example be only on values higher than, or only on values lower than the target value. For example, a target weight and a tolerance range between 0% and +5% can be provided, which means that weights below the target are not allowed. For example, tolerance intervals of this type can be set for anti-fraud law requirements, i.e. for avoiding the marketing of packages containing a quantity of product lower than that declared.

In practice, according to embodiments described herein, only a few logs are taken randomly from the normal path along the production line to be measured. The logs taken from the normal feed path are automatically transferred to the measurement station, subjected to one or more measurements automatically, and then inserted again into the normal feed path along the production line.

In this way the measurements can be performed automatically, without the need for operators taking the logs from the line, and with an automatic adaptation of the operating parameters of the line in order to correct any deviations of the features of the logs produced with respect to the desired features.

With reference to the drawing, FIG. 1 schematically shows a web material converting line for producing logs of web material, for example tissue paper. The line for producing logs, indicated as a whole with number 1, can have a plurality of stations, units, groups or machines, some of which are schematically represented in FIG. 1. In some embodiments, the production line 1 comprises an unwinding station 3, where one or more large diameter reels, or master reels B1 and B2 are arranged, on which plies V1, V2 of web material, for example cellulose plies, such as tissue paper plies, are wound. Unwinding stations are known to those skilled in the art, and can be made in different ways. Therefore, the details thereof will not be described herein. In the illustrated example, two reels are provided, which supply two plies V1, V2, but it shall be understood that the number of reels and the number of plies from the unwinding station 3 can be different.

One or more processing stations for the plies V1, V2 can be arranged downstream of the unwinding station 1. For example, a printing station or unit can be provided, for printing one or both plies, individually or after having bonded them together. In some embodiments, in addition to, or as a replacement of, the printing station, an embossing unit 5 can be provided, as schematically shown in FIG. 1. The plies V1 and V2 can be embossed and bonded, for example glued, in the embossing unit 5, so as to form a multi-ply web material N.

Numerous embodiments of the embossing unit or the printing unit (not shown) are known to those skilled in the art, and will not be described herein.

The web material N can be fed to a rewinder 7, for instance a continuous automatic peripheral rewinder, of a known type, where the web material is wound in logs R, with or without an inner winding core. Rewinders are also known to those skilled in the art, and they will not be described in detail herein.

The logs produced by the rewinder 7 have a final free edge, or tail, that shall be attached to the outer cylindrical surface of the log so as to prevent the log from unwinding during the subsequent processing. To this end, downstream of the rewinder 7, a tail sealing machine 9 for sealing the tail of the log can be provided, which seals, by gluing, embossing, mechanical ply-bonding or in any other suitable manner, the final edge L of each log R.

In general, an accumulator 10 is provided downstream of the tail sealing machine 9, dividing the production line 1 into two parts, which may have fluctuating production speeds, i.e. production speeds that vary over time differently in the two line portions. The accumulator 10 forms a sort of tank or storage, allowing the production speed of the rewinder to vary with respect to the production speed of the machines downstream of the accumulator 10. Among these machines, a severing machine 12 can be provided, which cuts the logs R into single rolls of smaller axial length, destined to packaging in downstream packaging stations, not shown.

In embodiments described herein, along the feed path, in particular between the rewinder 7 and the severing machine 12, the logs R move forwards in a direction substantially orthogonal to the winding axis thereof. Along this segment of path a measurement station 11 is provided, to which some logs, randomly taken from the logs moving forwards along the production line 1, are deviated to be subjected to measurement of one or more winding parameters, before being cut into small rolls by the severing machine 12.

In the illustrated embodiment, the measurement station 11 is arranged between the tail sealing machine 9 and the accumulator 10. However, the measurement station 11 can be arranged in a different position, for example downstream of the accumulator, or upstream of the tail sealing machine 9. However, as it will be clearly apparent from the description below, the arrangement directly upstream of the accumulator 10 has some advantages as regards inserting the logs R, taken from the feed path for being measured, again in the feed path.

In practical embodiments, the production line 1 comprises an ordinary feed path extending from the tail sealing machine 9 towards the accumulator 10, passing under the measurement station 11. A measurement path, deviated from the ordinary one, is also provided for transferring randomly selected single logs from the ordinary path to the measurement station 11 and then from this station to the accumulator 10.

The measurement station 11 is adapted to randomly take single logs R from the flow of logs R moving forwards along the production line 1. The logs can be taken at fixed intervals or at intervals that can be varied according to the needs. First transferring members, described below, transfer selected logs from the usual feed path along the production line 1 to the measurement station 11. Second transferring members insert the logs, taken for being measured, from the measurement station 11 again in the feed path along production line 1.

Below, the features and the structure of the measurement station 11 and of the first and second transferring members will be described with particular reference to FIGS. 2, 8, 12A, 13.

In the illustrated embodiment, the measurement station 11 is arranged at a greater height than that of the normal path of the logs R along the production line 1. In possible embodiments, the first transferring members comprise elevating members that lift each log R, selected for being measured, to the measurement station 11. The second transferring members can comprise devices, which transfer the logs R from the measurement station to the accumulator 10. The accumulator can extend vertically, as shown in FIG. 1, up to a position higher than the position at which the measurement station 11 is located, so that the second transferring members do not have to lift or lower the logs.

In some embodiments, the production line 1 comprises a chute 15 extending from the tail sealing machine 9 towards a feed unit 17, which transfers the logs R from the chute 15 towards the accumulator 10. The feed unit 17 may comprise a roller conveyor, a chute, a belt system or other transferring arrangement 19 for transferring the logs R towards a distributor 21, which discharges the logs R on the accumulator 10 in a controlled manner. The distributor 21 may comprise a butterfly rotating around an axis 21A according to arrow f21. An electric motor or other actuator 22 controls the rotation of the distributor 21 so that it rotates in a manner coordinated with the movement of the members of the accumulator 10, in order to transfer the logs to the accumulator 10. This latter has a plurality of cradles 23, attached to chains or other continuous flexible members 25. Accumulators of this type are known to those skilled in the art, and therefore will not described in greater detail. It is sufficient to remember that the cradles 23 are divided into empty cradles and cradles filled with logs R. The continuous flexible members 25 are driven around fixed and movable pulleys, the position of which varies according to the amount of logs accumulated in the accumulator 10. Examples of accumulators that can be used in a production line 1 of this type are disclosed in U.S. Pat. No. 9,132,962 or 6,053,304.

The chute 15, the feed unit 17 and the accumulator 10 define the ordinary path along which the logs R move from the tail sealing machine 9 to the severing machine 12. As mentioned above, some logs R are individually taken from the ordinary path and transferred by means of the first transferring members to the measurement station 11 and then inserted again into the ordinary path by means of second transferring members.

In some embodiments, for transferring single logs R from the main path, first transferring members are provided, indicated as a whole with number 31, which can be arranged so as to take single logs R in a position between the chute 15 and the feed unit.

Figure 13:
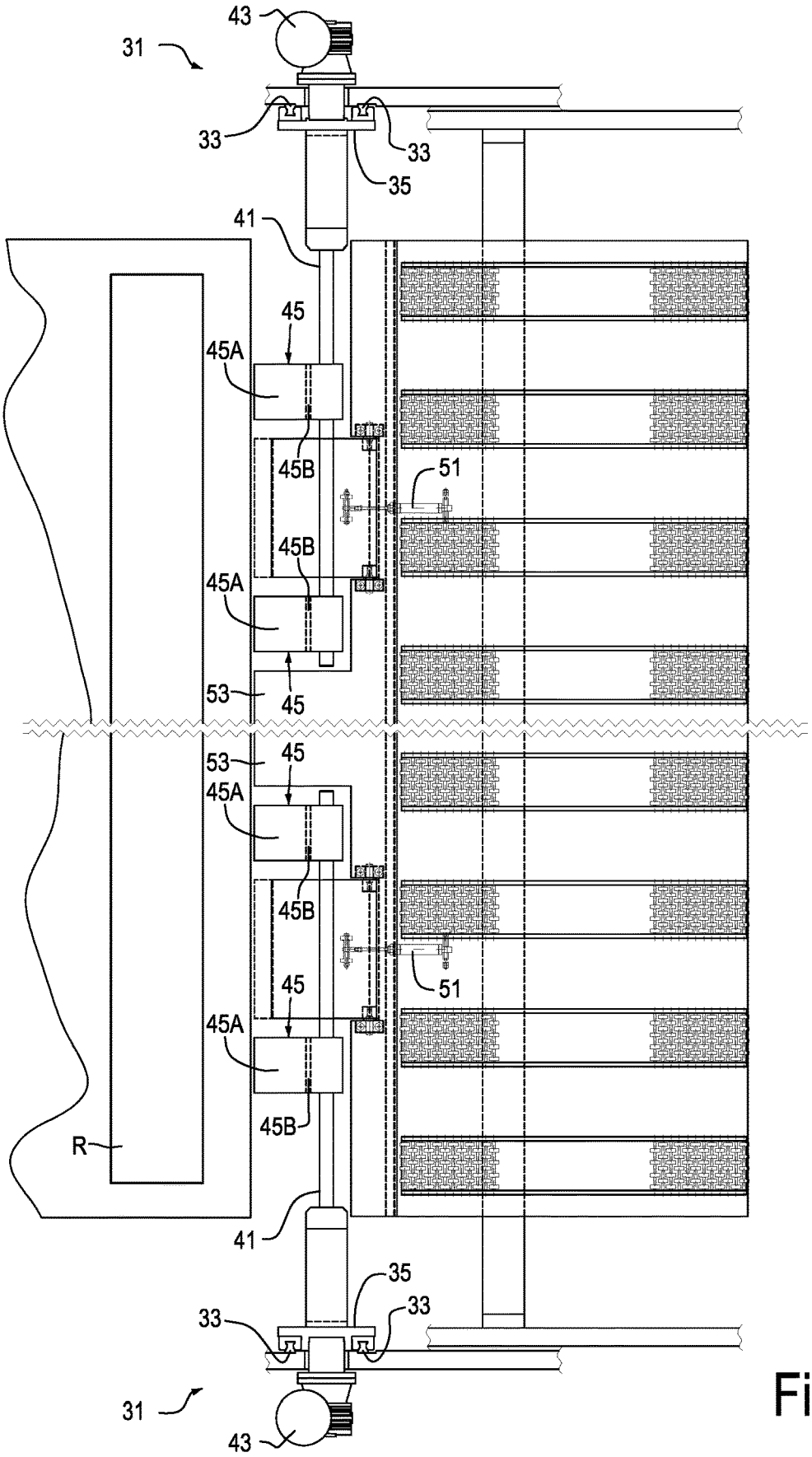
FIG. 13 shows a view along line XIII-XIII of FIGS. 2 and 9.
Figure 14:
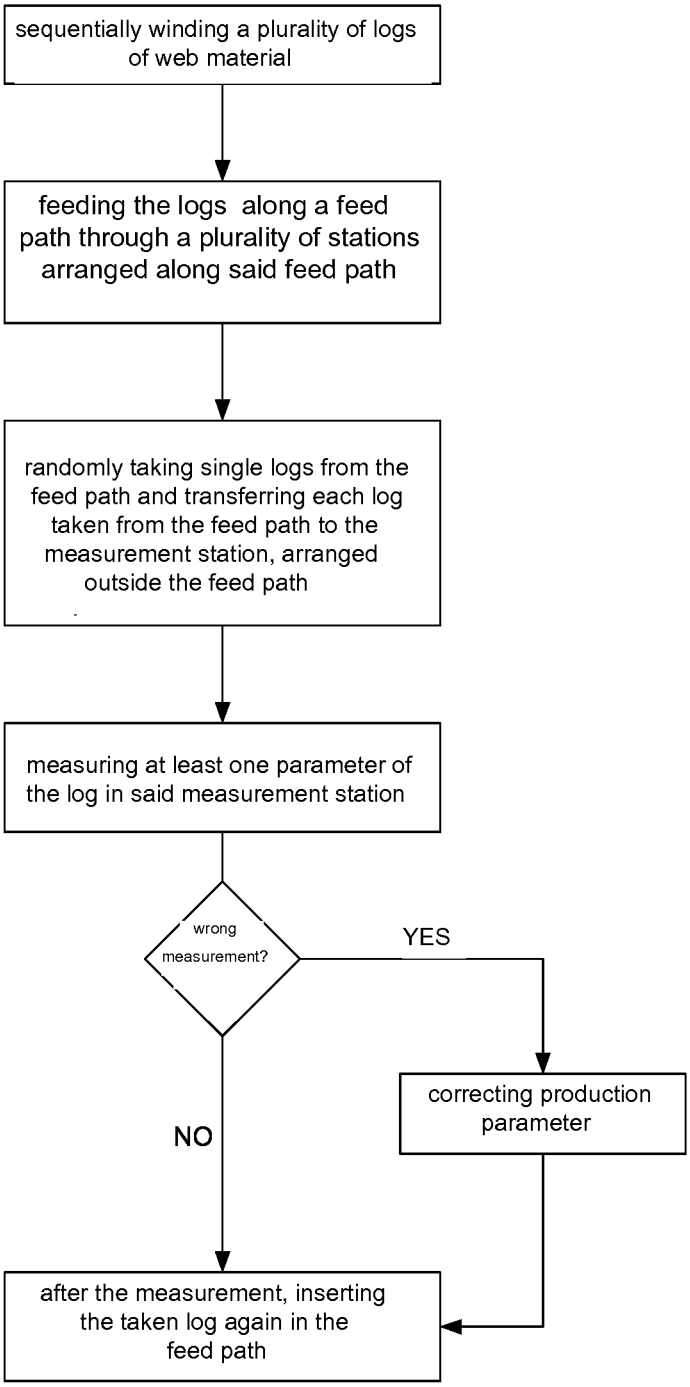
FIG. 14 is a flow chart summarizing a method according to the present description.

The first transferring members 31 may comprise guides 33 on both sides of the production line 1, fixed for example to flanks 34 (see in particular FIG. 13). For example, two guides 33 can be fixed on each flank 34. The guides can extend upwards in vertical or inclined direction, as in the illustrated example.

Figure 2:
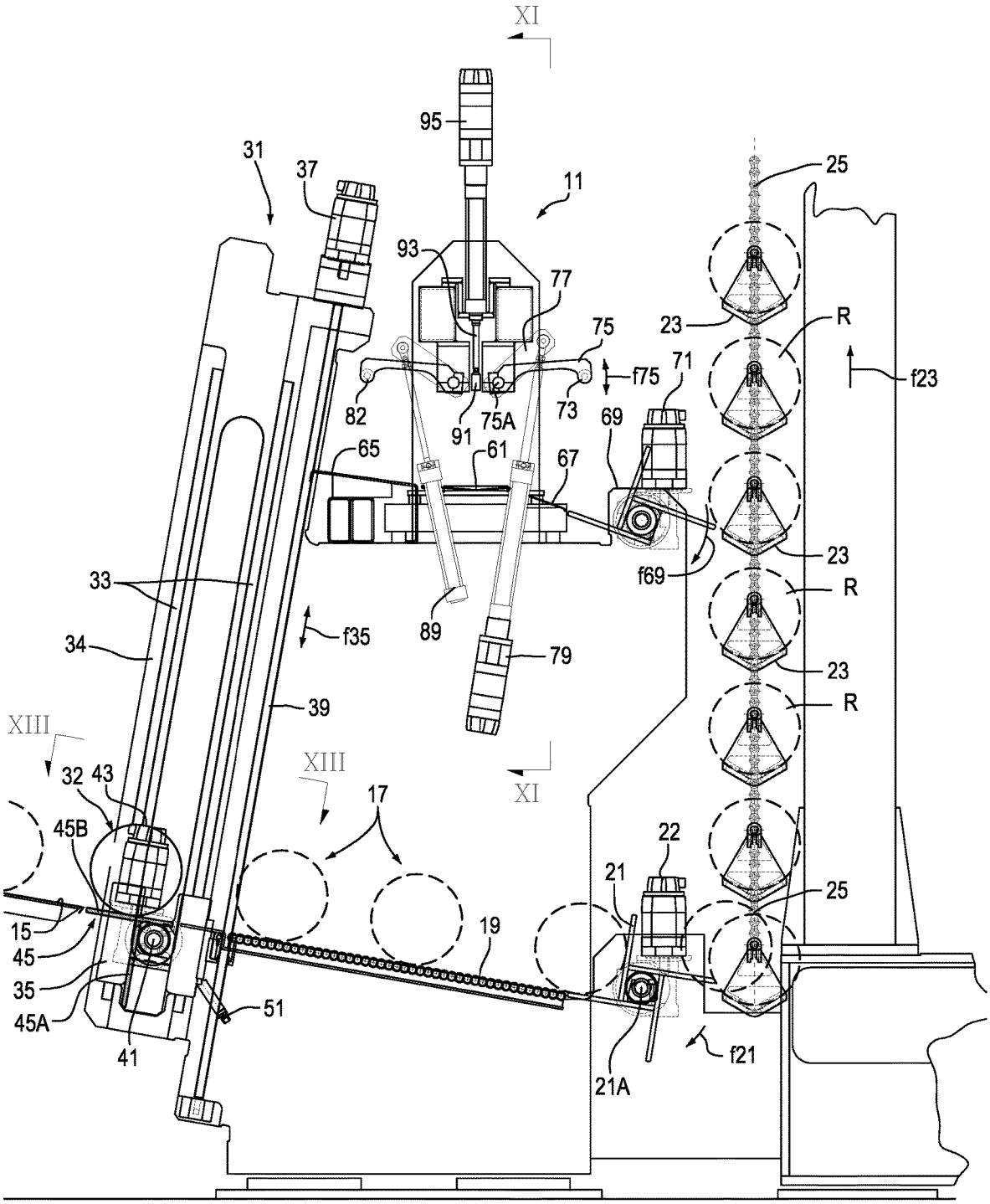
FIGS. 2 to 7 are side views of a portion of the production line of FIG. 1, with the measurement station in different steps of measuring a log.

Along the guides 33 an elevator 32 moves to lift the logs R, which must be taken from the ordinary feed path and transferred to the measurement station 11. The elevator 32 is part of the transferring members 31. In the illustrated embodiment, the elevator 32 comprises a slide 35 for each flank 34, as shown in particular in FIGS. 2 and 13. Each slide 35 is guided along respective guides 33. The lifting and lowering movement of the slides 35 along the guides 33 can be controlled by respective motors 37, shown in FIG. 2. Each motor 37 rotates a threaded bar 39, which meshes with a nut screw integral with the respective slide 35. The nut screws and the threaded bars 39 have been omitted in FIG. 13 for the sake of simplicity. In FIG. 2, the lifting and lowering movement imparted to the slides 35 by the motors 37 is indicated with f35.

In some embodiments, each slide 35 carries members for gripping the logs R. In the embodiment shown in the accompanying drawing, the gripping members comprise, for each slide 35, a shaft 41, which extends orthogonally to the guides 33 and transversely to the feed path of the logs R. Each shaft 41 is associated with a motor 43 controlling the rotation of the respective shaft 41 about the axis thereof.

In some embodiments, each shaft 41 is integral with a rotor, or preferably with at least two rotors 45. Each rotor 45 comprises two blades 45A, 45B. In the position of FIGS. 2 and 13, the blades 45A are aligned with the chute 15, from which the logs R exiting from the tail sealing machine 9 arrive. The blades 45B are substantially orthogonal to the blades 45A and, in the arrangement of FIGS. 2, 13, they are approximately parallel to the direction f35 of movement of the elevator 32 comprising the slides 35. The blades 45B form abutments for the logs R which, coming from the tail sealing machine 9, must be lifted to the measurement station 11.

Figure 8:
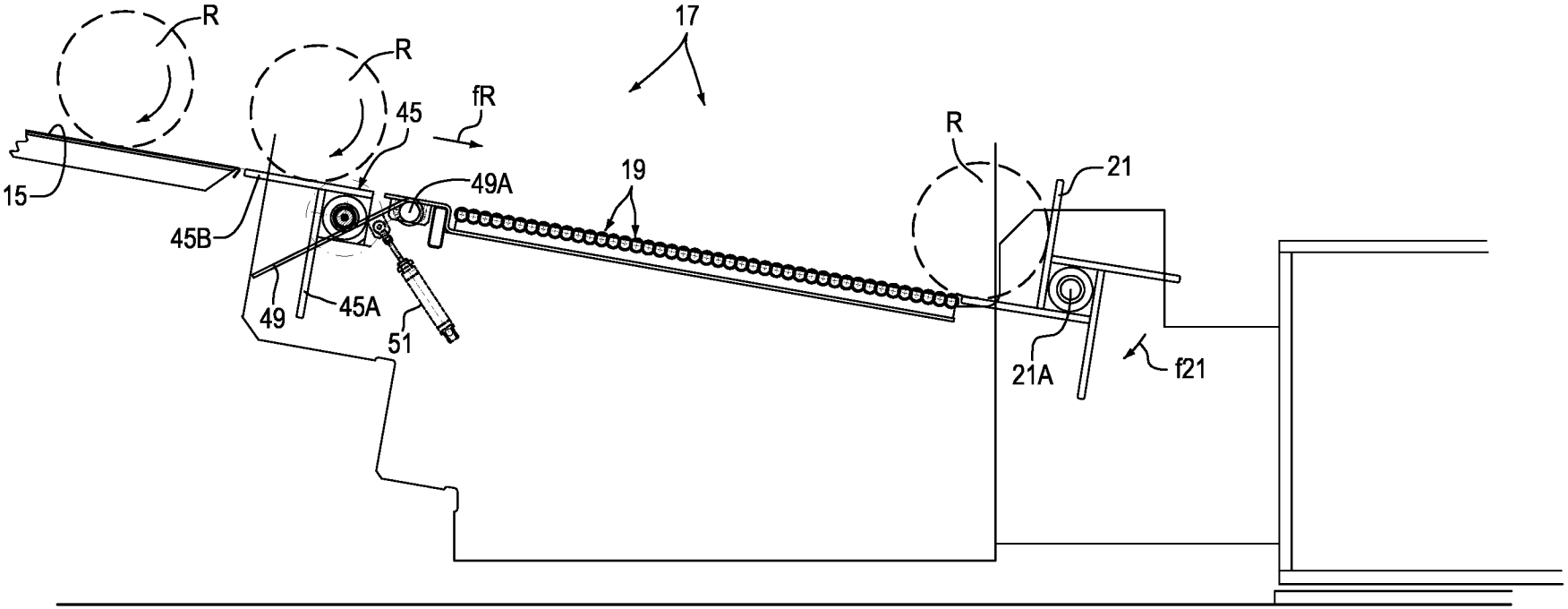
FIGS. 8 to 10 show an enlargement of the area where the logs are taken from the log production line under various operating conditions.

In the step shown in FIG. 2, a log R is engaged by the elevator 32 comprising the slides 35 and therefore the forward movement thereof along the ordinary path along the production line 1 has been stopped by the abutments formed by the blades 45B of the rotors 45. In FIG. 8, the rotors 45 are in a position such that the blades 45B are aligned with the chute 15 and the blades 45A are arranged below the blades 45B. The logs R are free to roll moving forwards according to the arrow fR along the ordinary feed path towards the roller conveyor 19.

The rotation of the rotors 45 is controlled by the motors 43 associated with each slide 35, and serves to stop the logs R, which must be taken to be transferred to the measurement station 11, according to a measurement cycle, which will be described later.

Figure 9:
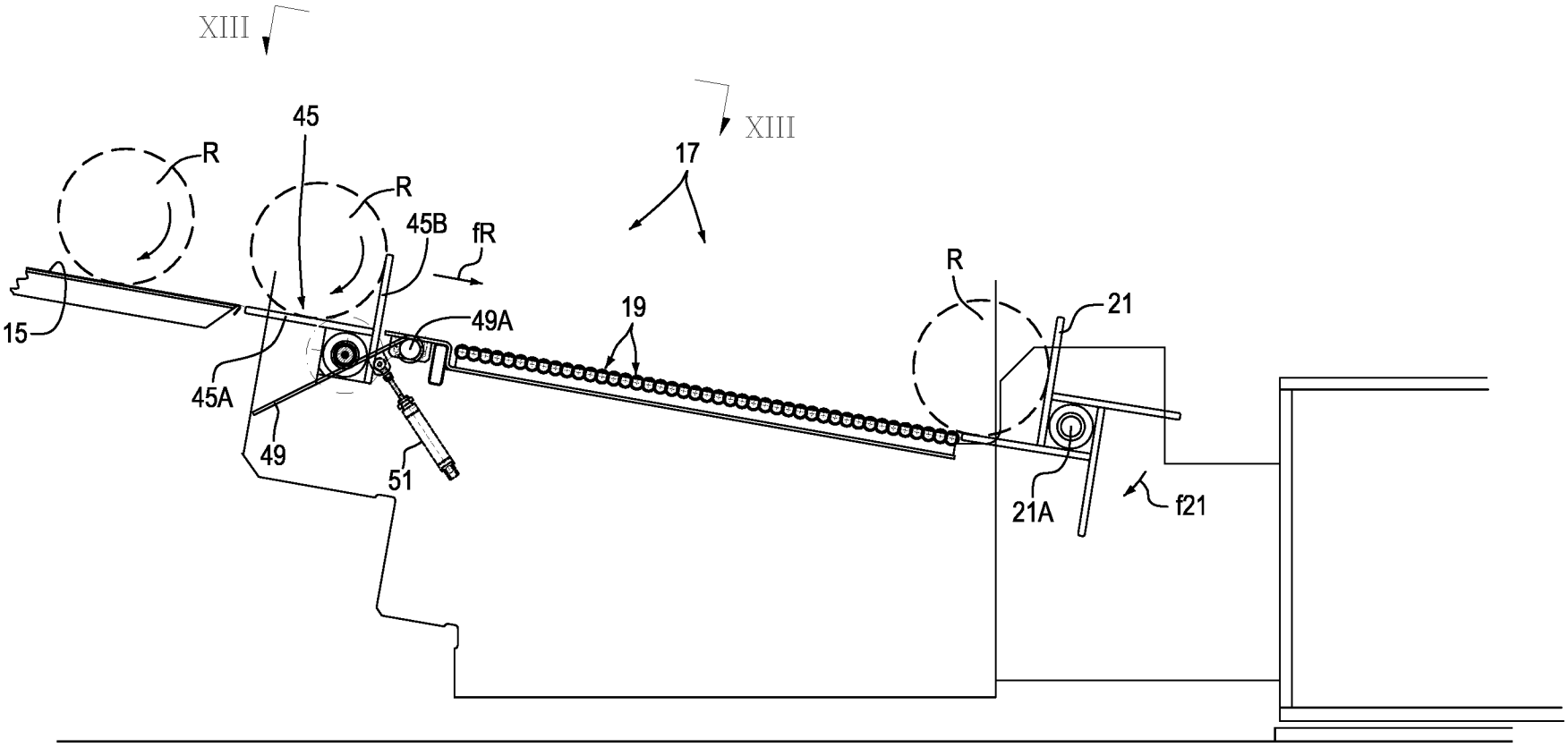
Figure 10:
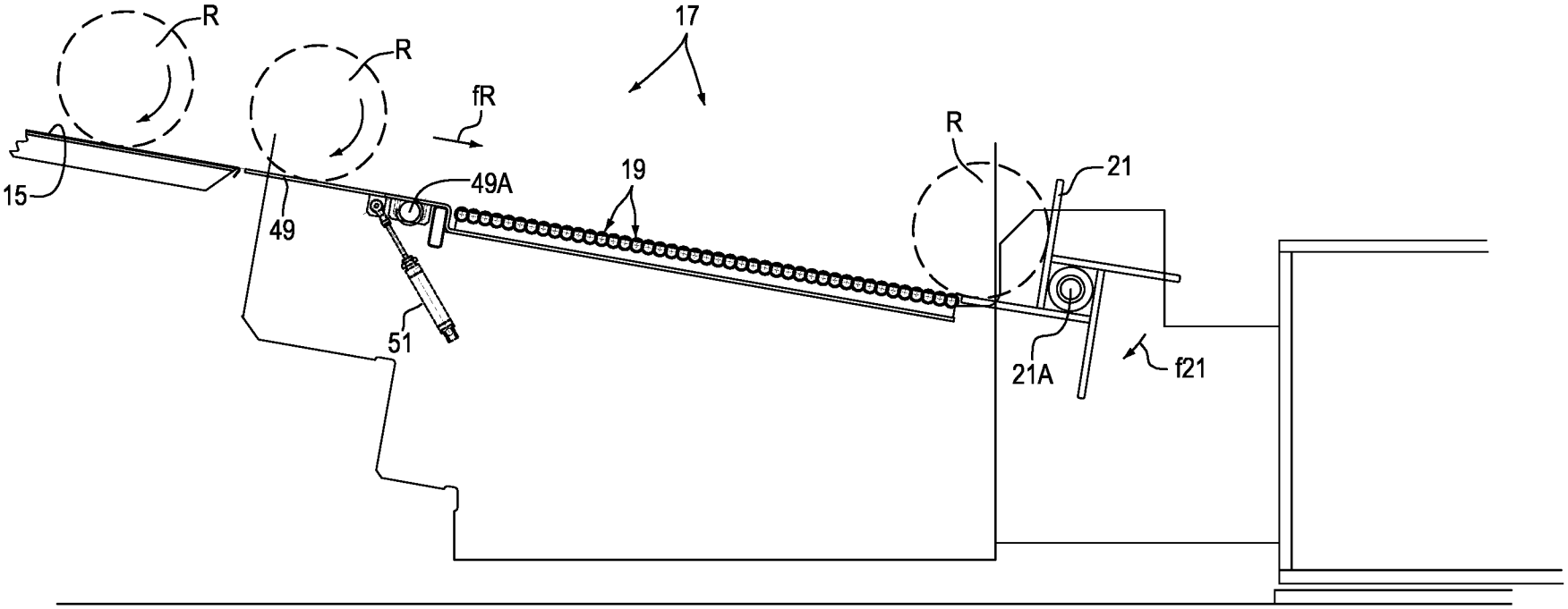

In some embodiments, to the rotor 45 of each shaft 41 or, when two rotors 45 are provided for each shaft, between the two rotors 45 as shown in FIG. 13, a pivoting plate 49 is provided, hinged around an axis 49A (FIG. 8) substantially horizontal and parallel to the axes of the logs R moving forwards along the ordinary feed path from the chute 15 towards the roller conveyor 19. In some embodiments, each pivoting plate 49 can be biased by a spring, for example by a pneumatic spring or piston 51, towards a position aligned with the chute 15, as shown in FIG. 10. When the slides 35 with the respective shafts 41 and rotors 45 are in the lower position of the guides 35, as shown in FIGS. 2, 8 and 9, however, the shafts 41 keep the plates 49 in a downwardly rotated position, as shown in particular in FIG. 8, against the thrust exerted by the springs 51. As will be explained below, the plates 49 move to the position aligned with the chute 15 when the elevator 32 comprising the slides 35 is at a higher height than the ordinary feed path of the logs along the production line.

In advantageous embodiments, in the intermediate area between the two pairs of rotors 45, a fixed plate 53 is provided, which extends as an extension of the chute 15 towards the roller conveyor 19, so as to form, together with the chute 15 and the roller conveyor 19, a feed surface for the logs R rolling from the chute 15 towards the rotating distributor 21.

Figure 11:
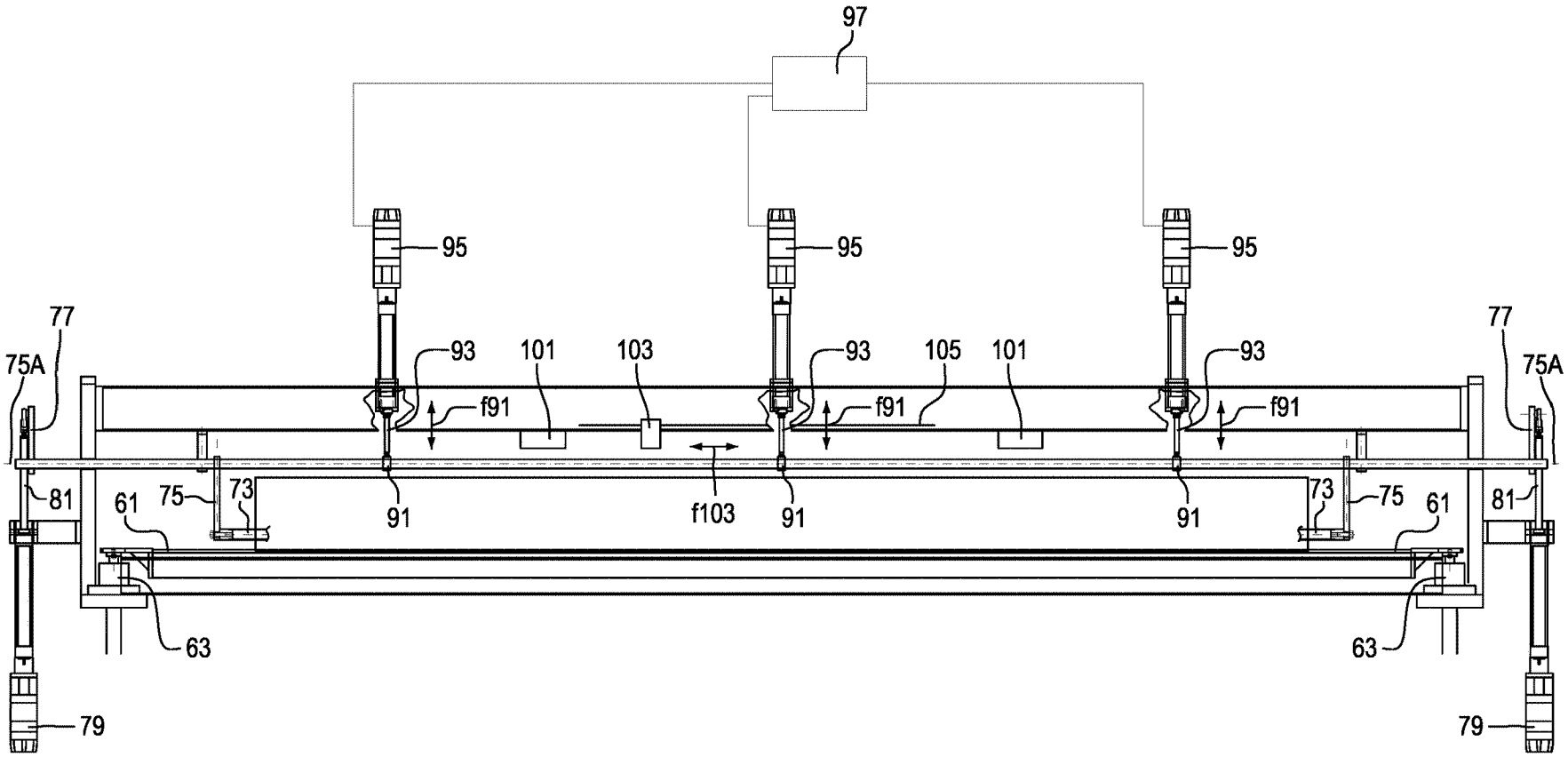
FIG. 11 is a view according to XI-XI of FIGS. 2 and 12A.
Figure 12A:
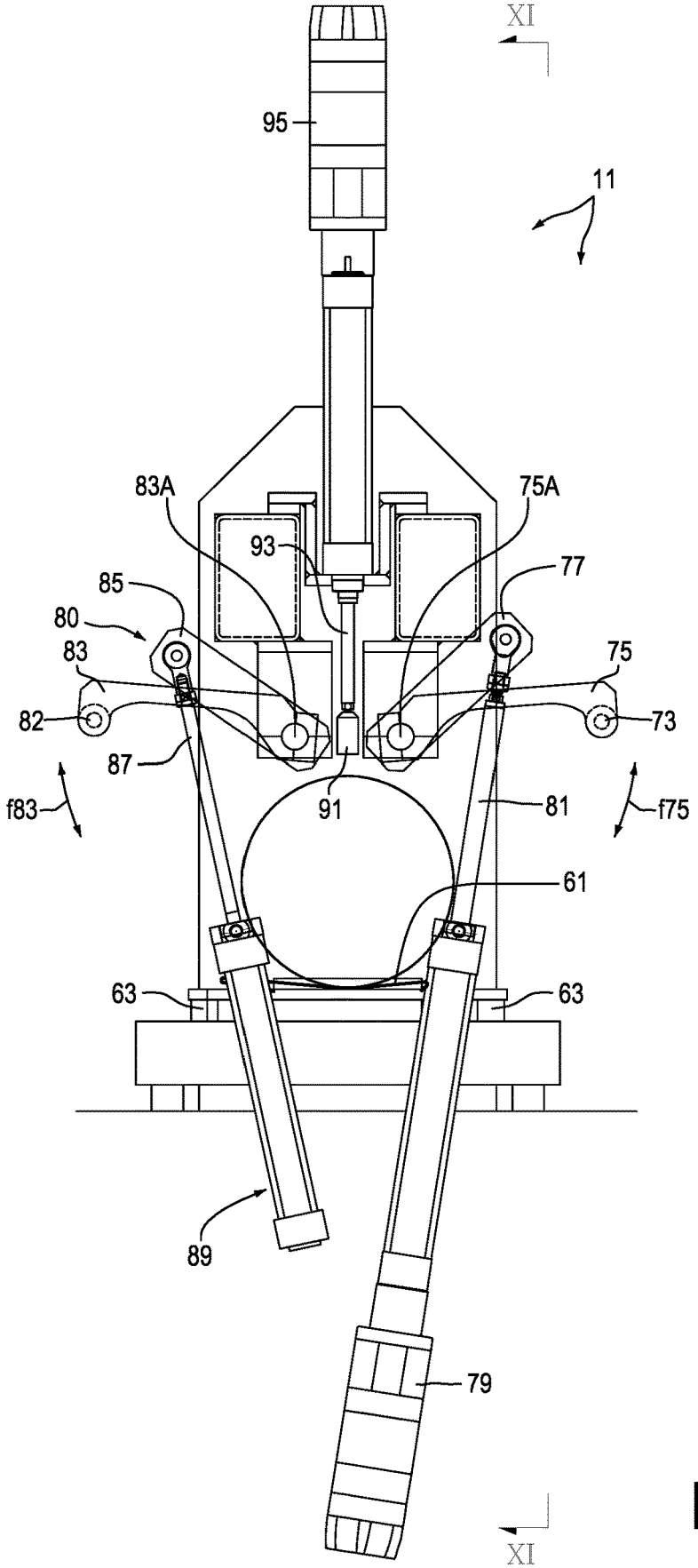
FIGS. 12A and 12B show an enlargement of the measurement station in two operating conditions.

With particular reference to FIGS. 2, 11 and 12A, the main elements of the measurement station 11 will be described below.

The measurement station 11 comprises a cradle 61, on which the logs R transferred to the measurement station 11 are arranged. The cradle 61 forms a seat for the logs in the measurement station and can have a V-shape and can be supported by a load cell system 63, adapted to measure the weight of the log R, which is positioned on the cradle 61. At one side of the cradle 61 there is an entrance chute 65 for transferring the logs by rolling, from the transferring members, including the slides 35, which form part of the elevator 32. At the opposite side of the cradle 61 an exit chute 67 is provided for discharging the logs from the cradle 61 towards a rotating distributor 69, similar to the rotating distributor 21, driven in rotation by a motor 71. The rotating distributor 69 receives the logs from the cradle 61 and transfers them, in the manner described in greater detail below, in respective cradles 23 of the accumulator 10. The chute 67 and the rotating distributor 69 are part of second transferring members adapted to transfer the logs R, after the measurement, from the measurement station 11 to the accumulator 10.

In order to arrange the logs R in the cradle 61, a retractable abutment can be provided, which can be arranged so as to stop the log R in the center line of the cradle 61 and retract to allow the removal of the logs R from the measurement station 11 after measurement thereof.

In some embodiments, the retractable abutment can comprise or can be formed by a bar 73 carried by two arms 75 hinged in 75A so as to pivot according to the double arrow f75. The bar 73 extends parallel to the cradle 61 and to the axis of the logs R that are positioned in the cradle 61 to be measured. The arms 75 and the bar 73 are provided on the exit side of the cradle 61, i.e. on the side from which the logs R exit from the measurement station 11 to be inserted again in the ordinary path of the production line 1.

Figure 12B:
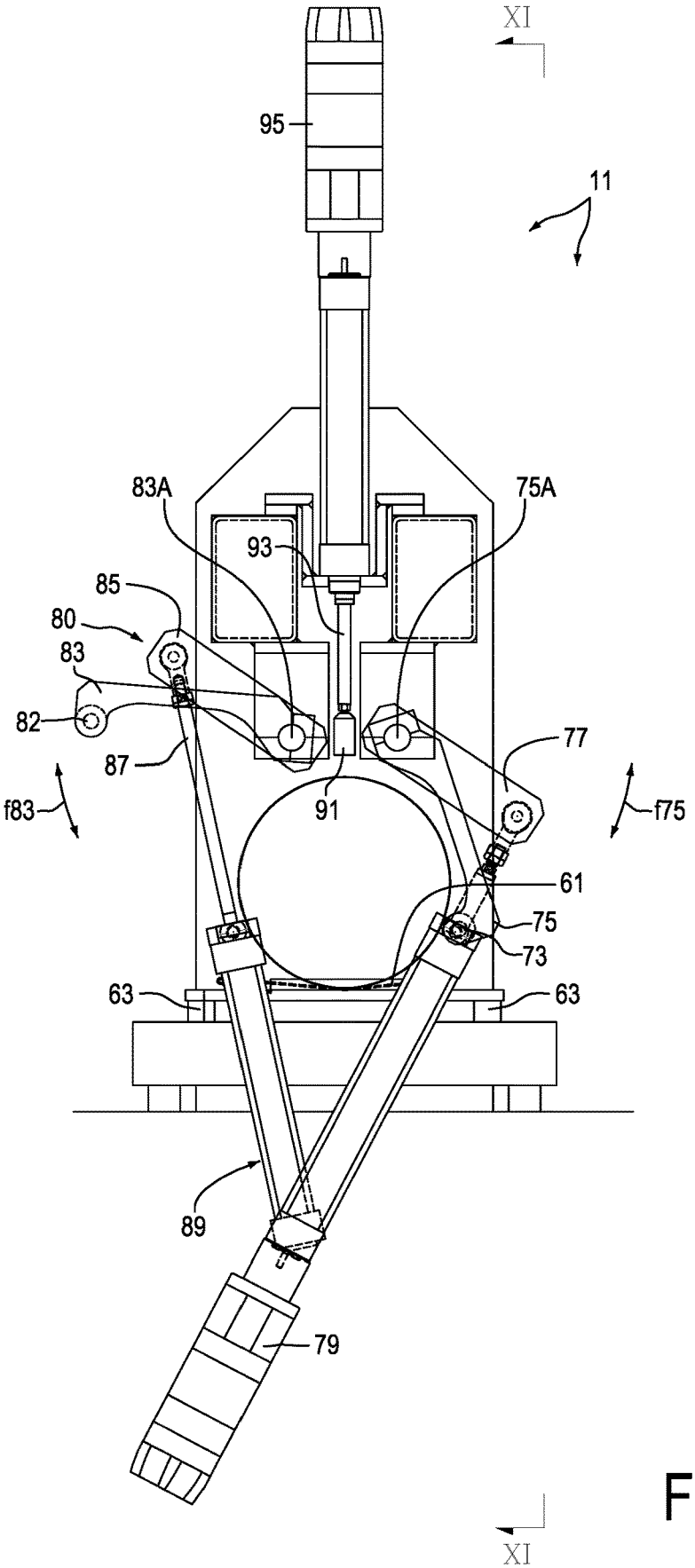

The pivoting movement according to the double arrow f75 is imparted, by means of arms 77 integral with the arms 75, by a pair of actuators 79. In some embodiments, the actuators 79 may comprise electronically controlled electric motors, which control the lengthening and shortening of a bar 81 connecting to the arms 77. As can easily be understood by comparing FIGS. 12A and 12B, for example, by lengthening and shortening the connecting bar 81 the arms 75 rotate and the position of the bar 73 around the axis 75A changes. Thanks to the use of electronically controlled electric motors 79 it is possible to adjust accurately the position of the bar 73 according to the diameter of the logs R, so that each log brought into the measurement station 11 can be correctly centered on the cradle 61.

On the side where the logs R enter towards the cradle 61, an ejector 80 can be arranged to eject the logs R from the cradle 61.

In some embodiments, the ejector 80 comprises or consists of an ejection bar 82 extending parallel to the bar 73 and to the cradle 61. The ejection bar 82 can be carried by arms 83 articulated in 83A and pivoting according to double arrow f83. The pivoting movement of the arms 83 and of the ejection bar 82 can be controlled by one or two cylinder-piston actuators 89, the rods 87 of which are articulated with arms 85, rigidly fastened to the arms 83.

By positioning the log R on the cradle 61, the load cells 63, or other suitable weight sensors, detect the weight of the log, as one of the possible parameters for controlling the production of the logs R.

The measurement station 11 may also comprise instruments for measuring the firmness of the logs R. Firmness is usually measured in a laboratory, with manual instruments that perform measuring cycles according to codified standards. With the measurement station 11 integrated into the production line 1, it is possible to measure the firmness in line, quicker and without the need to remove the logs from the production cycle.

In some embodiments, the instruments for measuring the log firmness can comprise at least one tracer with an actuator to perform a cycle for measuring the log firmness. In some embodiments, the measurement cycle may be performed as follows. The tracer is brought into contact with the cylindrical surface of the log and is stopped when the log surface generated on it a reaction force F1, for example 100 g. From this position, the tracer is moved forward in a controlled manner, for example by means of an electronically controlled electric motor, which can be provided with a suitable encoder or any other device adapted to detect the displacement of the tracer, or the rotation angle of the motor, from which the linear forward movement of the tracer can be obtained. The forward movement continues until a second reaction force F2 is reached, for example 1000 g. The firmness is measured as a parameter proportional to the stroke performed by the tracer between the first and the second measurement. The reaction force can be measured by means of a load cell or any other suitable sensor.

In some embodiments, the firmness measuring instruments may comprise a tracer movable along the cradle 61, to measure firmness in several points of the axial development of the log R positioned on the cradle 61.

For a faster operation, according to some embodiments, more tracers can be provided aligned along the cradle 61, which can carry out several measurements simultaneously or in any case in reduced times, without the need to move the tracer along the entire axial extension of the log. R. In some embodiments, some movable tracers may be provided along the longitudinal extension of the cradle 61, and each of them performs a certain number of measurements, without the need to translate along the whole extension of the cradle 61.

In other embodiments, a certain number of tracers may be provided, and all (or some of them) are in a fixed position with respect to the longitudinal extension of the cradle 61, so as to perform a measurement at a fixed and repeatable point of each log.

In the embodiment illustrated in the drawing, this latter solution is adopted with a plurality of tracers, in the example three tracers, in fixed positions along the longitudinal extension of the cradle 61, as shown in particular in FIG. 11. The tracers are indicated with reference number 91. Each tracer 91 is carried at the end of a rod 93 provided with a lengthening and shortening movement in vertical direction according to double arrow f91, to move the tracer 91 towards and away from the cylindrical surface of the log R, which is in the cradle 61. The movement of each tracer 91 according to arrow f91 is controlled by a respective electric motor 95 controlled by a programmable control unit 97. The control unit 97 can carry out a measuring cycle by moving the tracers 91 and calculating the displacements and the reaction forces between each tracer 91 and the log R, according to standardized measuring cycles.

In some embodiments, the firmness can be measured in several positions around the circular extension of the log. To this end, the log can rotate around the axis thereof, while it is in the measurement station. The rotation of the log can be obtained by providing motorized rollers, which act on the cylindrical surface of the log. To facilitate the rotation, the cradle 61 can comprise idle support rollers or wheels, or it can be formed by idle support rollers. In other embodiments, the cradle 61 can be provided with a pair of support rollers, at least one of which is motorized.

In some embodiments, the measurement station 11 can comprise a system for measuring the diameter of the log R. In some embodiments, the log diameter can be read by means of a camera placed laterally to the seat 61 so as to frame the head surface of the log. Based on the calibration of the camera and an image analysis software, known per se, it is possible to obtain the diameter of the log from the image thereof taken by the camera. The measurement can take into account the distance between the camera and the log, which can be suitably measured by means of known systems.

In other embodiments, the diameter can be measured by means of a linear measurement laser device arranged above the seat 61 in the center thereof, for example. The laser device measures the distance of the underlying side surface of the log and, based on the known distance of the seat, the log diameter is calculated. In FIG. 11, two laser meters 101 of this type are shown just by way of example, arranged in two different positions along the axial extension of the log R. In other embodiments, only one meter, or more than two meters may be provided.

As mentioned above, in some embodiments, the measurement station 11 may comprise one or more devices for measuring the depth of an embossing applied to the web material forming the log R. This may be particularly useful in case the processing line produces logs of tissue paper. The device can be a laser profilometer, of a known type. The profilometer can be in fixed position. Preferably the profilometer is movable along the axial extension of the log R, which is in the measurement station, so as to perform a measurement on a wider or narrower portion of the log. FIG. 11 schematically shows a profilometer 103 movable along a guide 105. The direction of movement of the profilometer 103 is indicated with f103. The movement can be controlled, for example, by an electric motor, which can be fixed with respect to the profilometer 101 and which can actuate a pinion engaging a rack integral with the structure, which also carries the laser meters 101 and the tracers 91. In other embodiments, the profilometer 103 can be moved by means of a continuous belt driven by a driving pulley.

In some embodiments, the travel of the profilometer may be limited to a part of the axial extension of the log R. In other embodiments, the travel of the profilometer can be equal to the whole dimension of the measurement station 11 in the direction of the axis of the log R.

In order to perform measurements of the embossing depth on several portions of the cylindrical surface of the log R, the log can be rotated around the axis thereof while it is in the measurement station 11.

The measurement detected by the profilometer 103 can be used to detect any errors between the measured and the set embossing depth. In some embodiments, especially if the profilometer moves along the whole, or most of, the axial length of the log R, it is possible to detect any defects consisting of a non-uniformity in the embossing depth, for example a greater embossing depth towards one end of the log and a smaller embossing depth towards the other end, or a greater (or smaller) embossing depth in the middle of the log than at the edges thereof.

The information obtained from the profilometer(s) arranged in the measurement station can be used alone or in combination with other measurements, for example the firmness, in order to intervene on production parameters. Among the production parameters that can be modified according to the measurements carried out by the profilometer there are: the embossing pressure; the mutual skewing of the axes of the embossing rollers and the pressure rollers; any variable crowning of the pressure roller of the embossing machine, and in general any parameter affecting the embossing depth.

The control unit 97 can be functionally connected to the devices for measuring the diameter and to the devices for measuring the embossing characteristics, for example one or more profilometers as defined above.

The control unit 97 can also be functionally connected to the remaining actuators, described above, which perform the following operations: lifting the logs R from the ordinary feed path towards the measurement station 11; positioning the logs in the cradle 61, ejecting the logs from the cradle 61; inserting the logs R coming from the measurement station 11 into the accumulator 10.

The operation of the production line 1 with the measurement station 11 described above is clearly illustrated in the sequence of FIGS. 2 to 7 and of FIGS. 8 to 11. FIGS. 2 to 7 show a side view of the measurement station 11 with the underlying feed unit 17 and the entrance of the accumulator 10, in various operating positions during a step of randomly taking a log R for the measurement. FIGS. 8 to 11 show details of the feed unit 17 and of the elevator 32 for transferring the taken logs R towards the measurement station 11, in various operating positions.

FIG. 2 shows a position where the rotors 45 have been arranged with the blades 45B in a position approximately aligned with the chute 15. The logs R coming from the tail sealing machine 9 can freely pass from the chute 15 through the transferring members 31 towards the rotating distributor 21, so as to be loaded into the cradles 23 of the accumulator 10.

FIG. 8 shows a simplified enlargement of the transit area of the logs R along the blades 45B in this arrangement.

Figure 3:
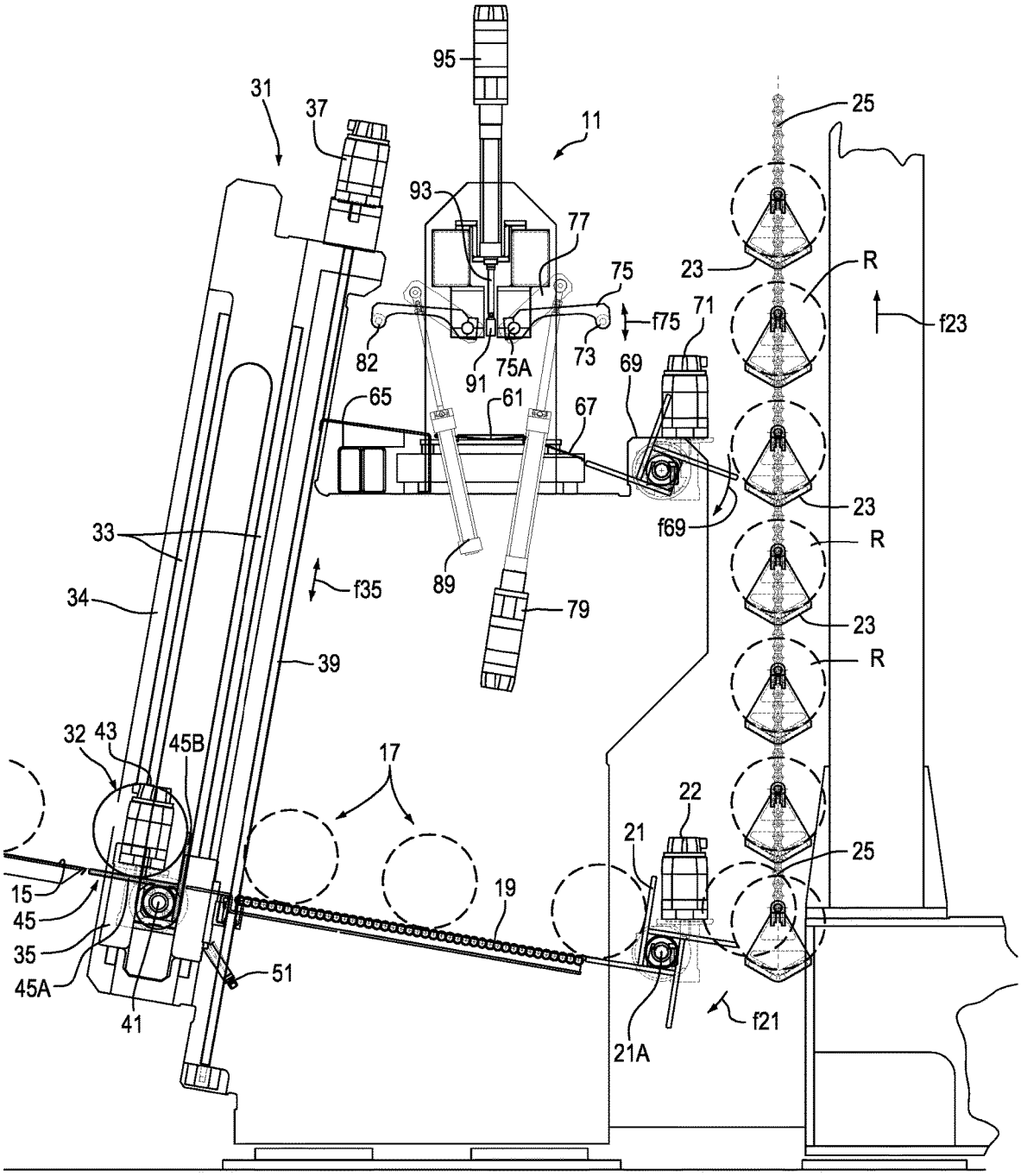
Figure 4:
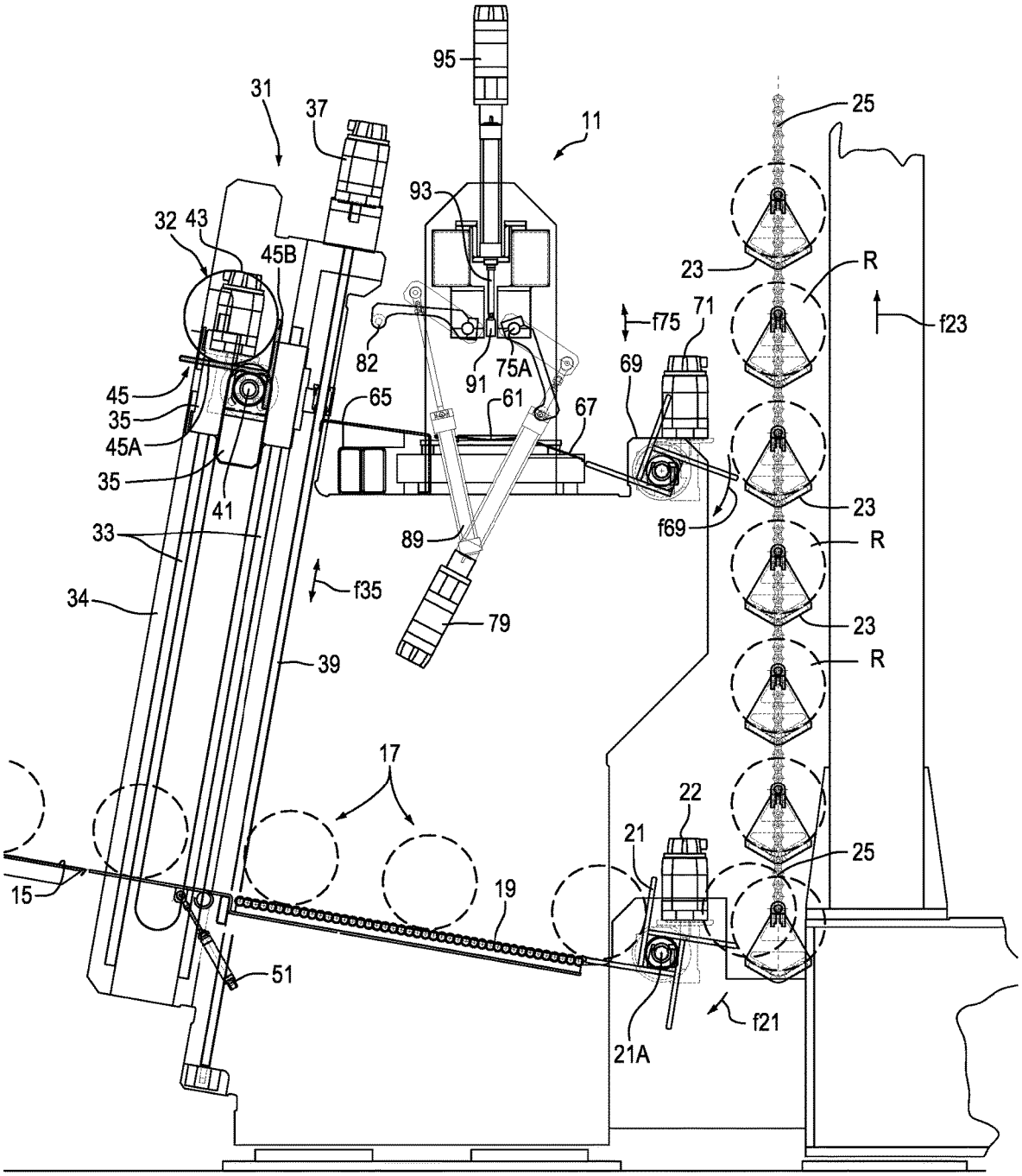

When a log R shall be taken from the normal feed path between the tail sealing machine 9 and the accumulator 10, by means of a control, for example imparted by the electronic control unit 97, the rotors 45 can be rotated by 90° so as to take the position of FIGS. 3 and 9, with the blades 45B substantially orthogonal to the chute 15. In this way, the next log R coming from the tail sealing machine 9 is intercepted and stopped on the elevator 32 of the logs R. The slides 35 of the elevator 32 are raised along the guides 33 by means of the motor 37, until they reach the position of FIG. 4.

In the measurement station 11, the bar 73 may have been arranged in the required position to stop the log R on the cradle 61.

In the lower area, the oscillating plates 49 are rotated in the position of alignment with the chute 15, so that the following logs R coming from the tail sealing machine 9 can freely move along the feed unit 17 to be loaded on the accumulator 10, as shown in detail in FIG. 10.

Figure 5:
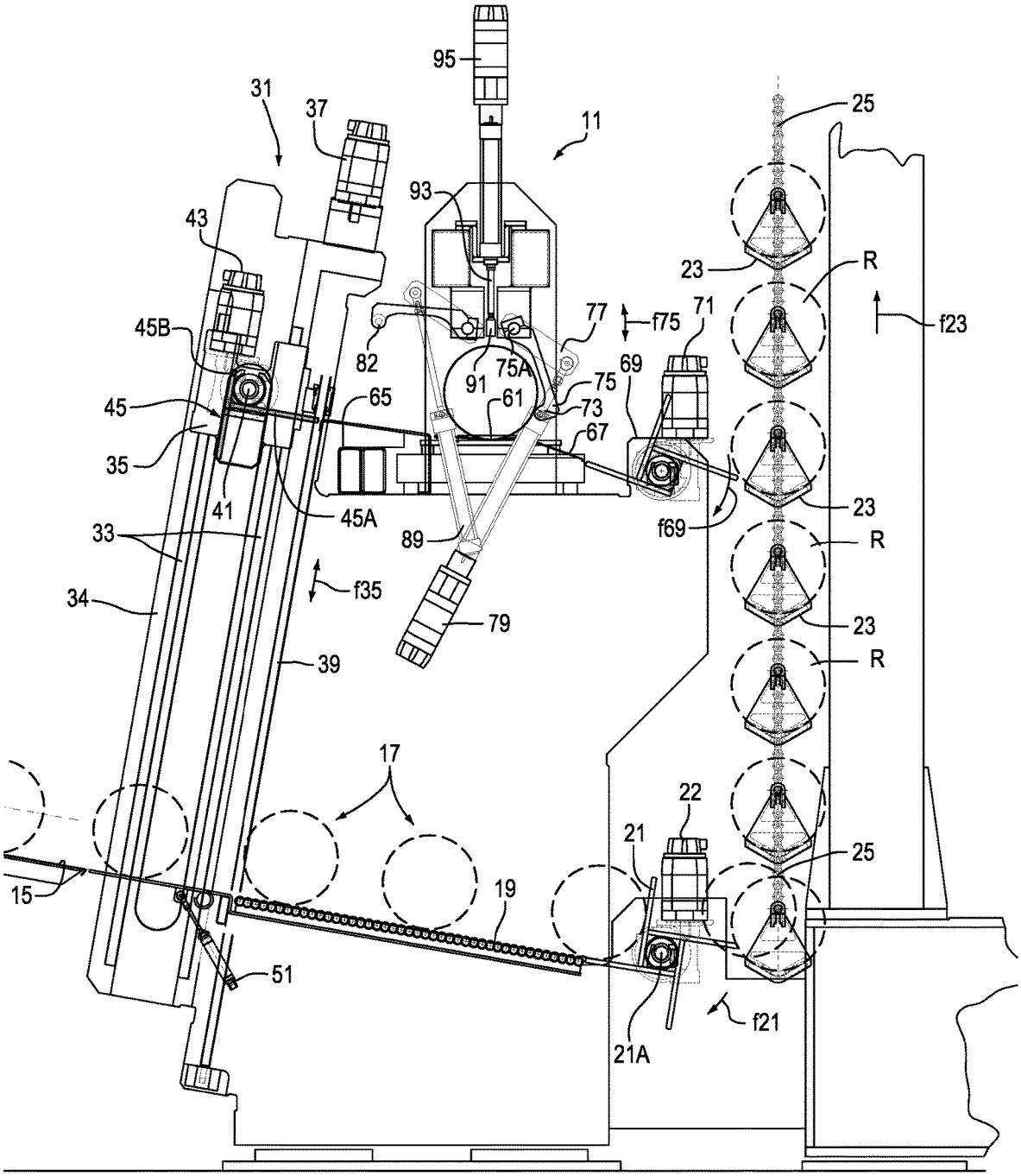

The log that has been lifted by the elevator 32 is discharged, by rotating the rotors 45, on the chute 65 and reaches the cradle 61, where it abuts against the bar 73, as shown in FIG. 5. The ejection members 80 are in a raised position to allow the passage of the log R. The condition illustrated in FIG. 5 is thus reached. In this position, one or more parameters of the log are measured, that is: the weight of the log R through the load cells 63, the firmness thereof through the tracers 91; the diameter through the laser device(s) 101 or other equivalent device, the embossing depth through the profilometer(s) 103, or other equivalent device. Data are collected by the central control unit 97.

Figure 6:
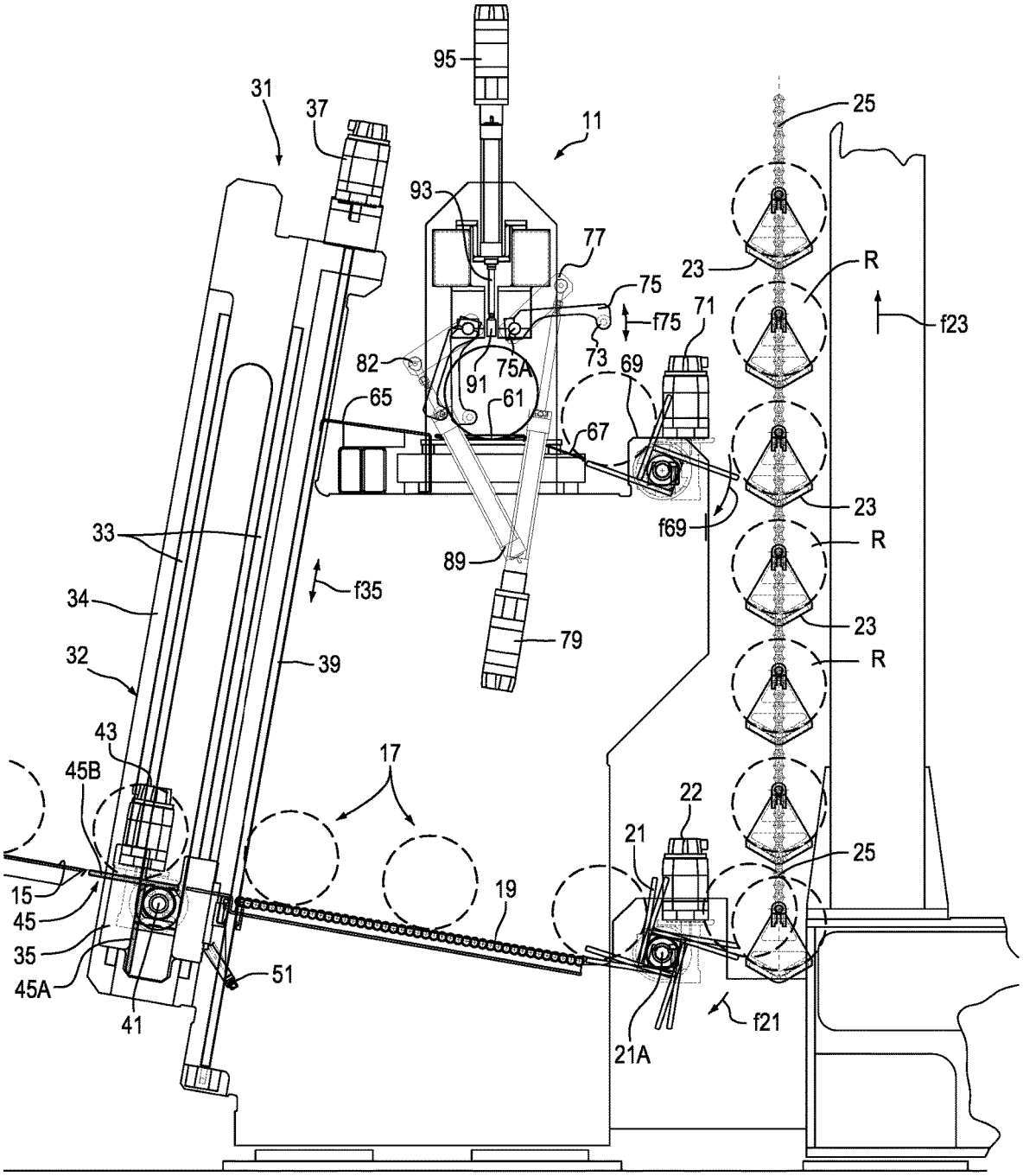

Meanwhile, the elevator 32 can be returned to the lowered position, with the blades 45B of the rotor 45 aligned with the chute 15, as shown in FIG. 6. This figure also shows the start of the ejection step of the log R from the measurement station. To this end, the motors 79 have raised the bar 73, and the actuators 89 rotate in anti-clockwise direction the ejection bar 82, which pushes the log R out of the cradle 61 and causes the rolling thereof along the chute 67 up to the rotating distributor 69.

Figure 7:
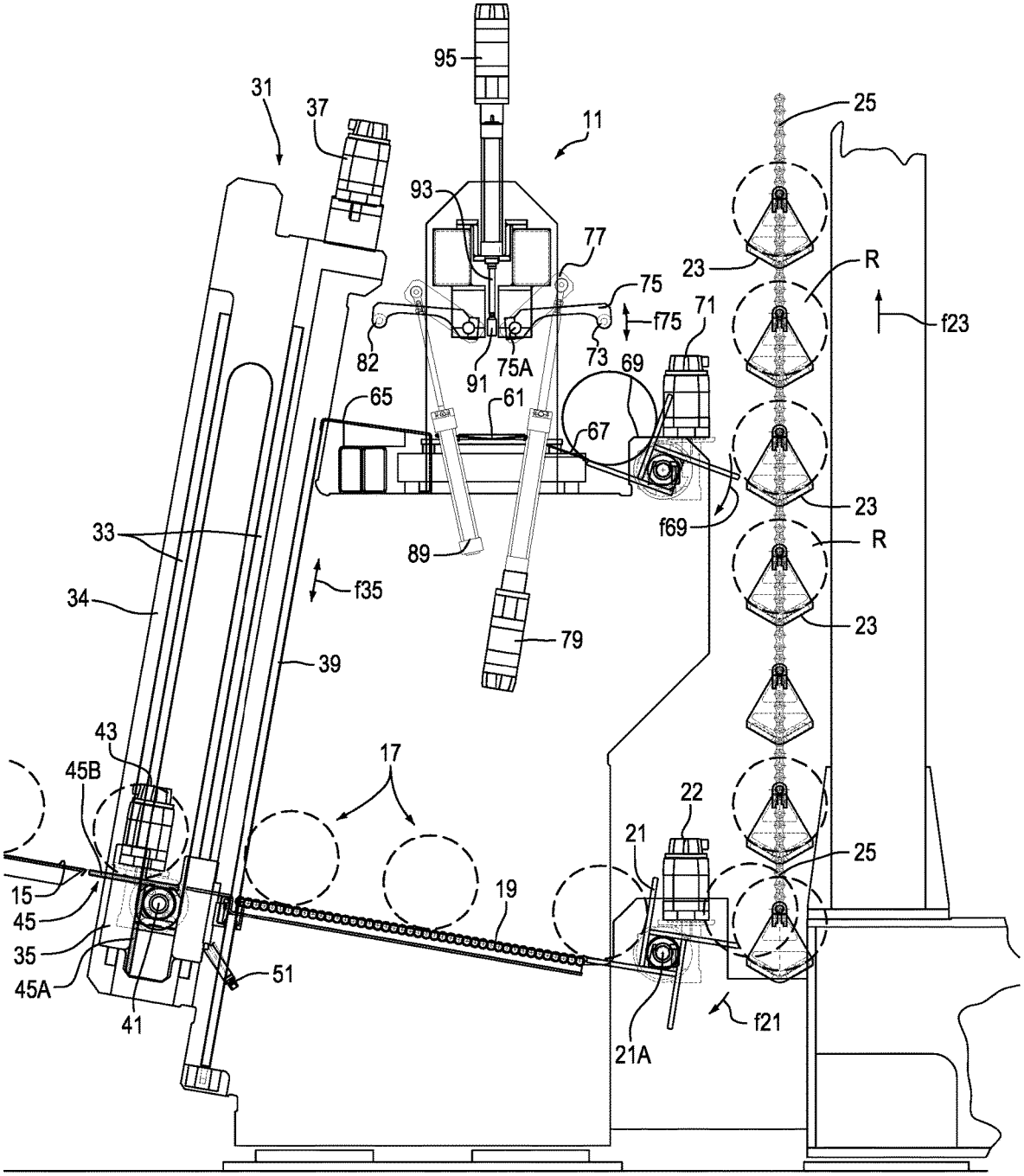

In FIG. 7, the log R on which measurements have been made is in the rotating distributor 69, waiting to be transferred to the accumulator 10. To this end, a cradle 23 of the accumulator 10 has been left free, as shown in FIG. 7. The rotation movement of the rotating distributor 69 is synchronized with the lifting movement (arrow f23, FIG. 7) of the cradles 23 of the accumulator 10, so that the log R is discharged from the rotating distributor 69 into the empty cradle 23.

Based on the measurements done in the measurement station 11, it is possible to check whether the characteristics of the logs set by the operator have been met. Otherwise, a simple signal can be provided to the operator, for example a message on a monitor, an optical or an acoustic signal or the like. As an alternative or in addition, the control unit 97 can intervene directly or indirectly (for example by interfacing with other control units of the production line 1) by adjusting one or more production parameters so as to ensure that the subsequent logs completely meet the set features.

Just by way of example, in case the firmness of the log R is not within the set range, the parameters of the rewinder 7 can be adjusted, to increase or decrease the firmness. This can be done, for example, by modifying the peripheral speed of the winding rollers, or the tension of the web material N upstream of the winding area. In addition or alternatively, it is possible to act on one or more operating parameters of the embossing unit 5, for example to increase or decrease the embossing depth. In still further embodiments, along the feed path of the plies V1, V2 and/or of the web material N dancer rollers can be provided for controlling the tension of the web material and/or of the plies, on which it is possible to act in order to modify the winding tension and therefore the firmness. In still further embodiments, it is possible to modify the pressure exerted by the winding rollers on the log R being formed in the rewinder 7.

The measurements done in the measurement station 11 can also be used in combination with other measures performed in other ways along production line 1. For example, it is possible to measure the diameter of the logs R produced by the rewinder 7. The data related to weight and diameter, as well as the data on firmness, can be used to modify the production parameters.

With reference to FIGS. 1 to 14, measurement methods have been described, in which logs R are randomly taken from the feed path along the production line 1 and transferred to a measurement station 11 that is outside the feed path. In this way, it is possible to carry out measurements on logs randomly taken from the feed path without slowing down the production and without the time necessary to carry out the measurements to influence the line productivity.

In other embodiments, the measurement station can be arranged along the normal feed path of the logs. In this case, considering that the time required for performing one or more measurements may be high with respect to the rate at which the logs normally move forward along the feed path, special measures may be taken to allow the flow of the logs and the random measurement. For example, in machines for producing tissue paper logs, production rates of one log per second can be achieved, while the measurements to be performed on a log may take several seconds.

Figure 15:
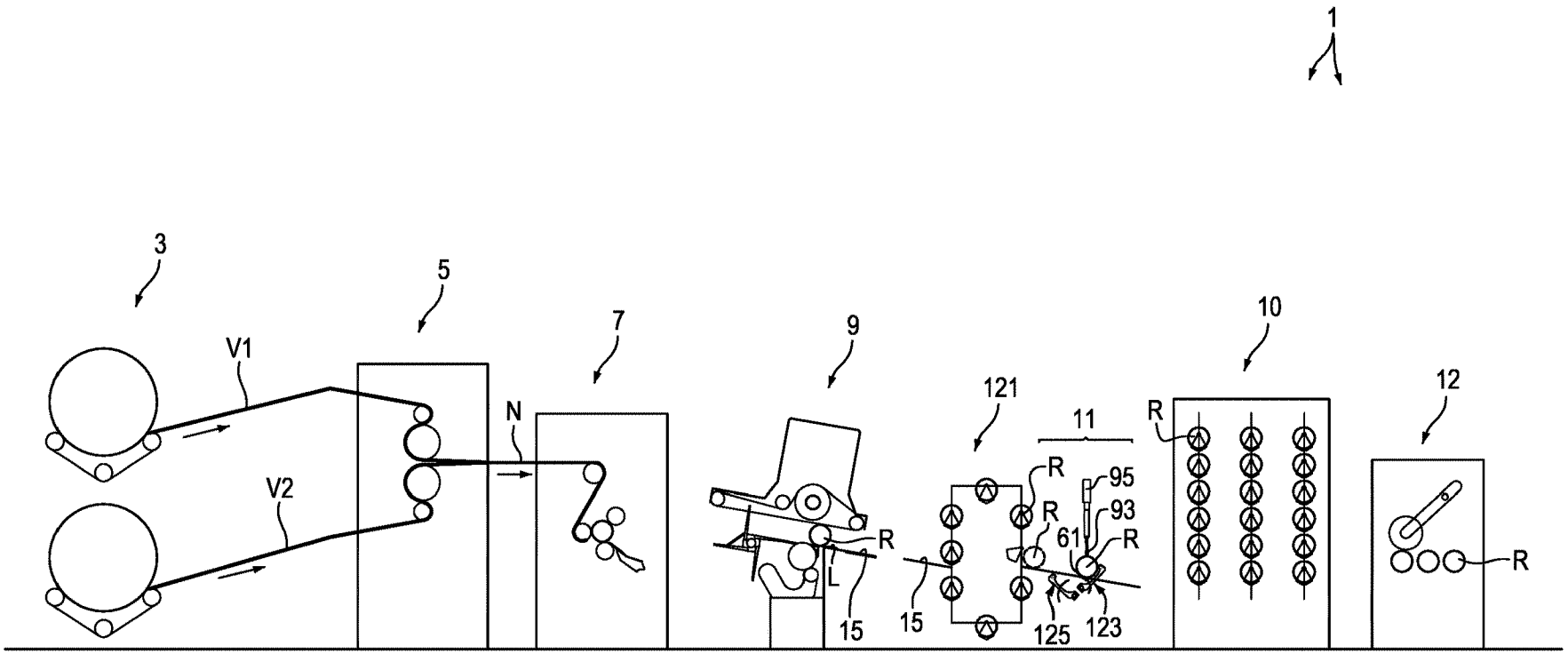
FIG. 15 is a diagram, similar to the diagram of FIG. 1, in a different embodiment.

FIG. 15 shows a diagram similar to the diagram of FIG. 1, in which equal or corresponding parts are indicated with the same reference numbers. In FIG. 15, the measurement station 11 is provided along the feed path of the logs and all the logs R pass through the measurement station 11. The measurement station 11 has a seat 61, where a log R can be temporarily kept. Measurement devices 11 as described above can be associated with the measurement station 11. Just by way of non-limiting example, in the simplified diagram of FIG. 15 only one device 91, 93, 95 has been shown for measuring the firmness of the log R. A temporary storage or accumulation device can be provided upstream of the measurement station 11. This temporary accumulation device can be formed by a simple inclined plate with a rotating distributor, for example similar to the rotating distributor 21. The rotating distributor stops the logs coming from the tail sealing machine 9 while a log is in the measurement station 11. After the measurement has been performed, the log is ejected and the logs that have accumulated upstream can be moved forwards quickly through the measurement station 11 to avoid the formation of an excessively long queue. Once the accumulated logs have been evacuated, a new series of measures can be carried out on a subsequent log.

In the diagram of FIG. 15 the temporary accumulation device, indicated with 121, is represented as an accumulation device similar (even if preferably much smaller) to the accumulator 11.

In order to facilitate the positioning of the logs to be measured in, and the removal thereof from, the seat 61, oscillating arms can be provided, as schematically indicated with 123 and 125, or other suitable means.

Alternatively, the seat 61 may be a rotating seat, which temporarily holds the log on which measurements must be performed in the measurement station 11.

Figure 16:
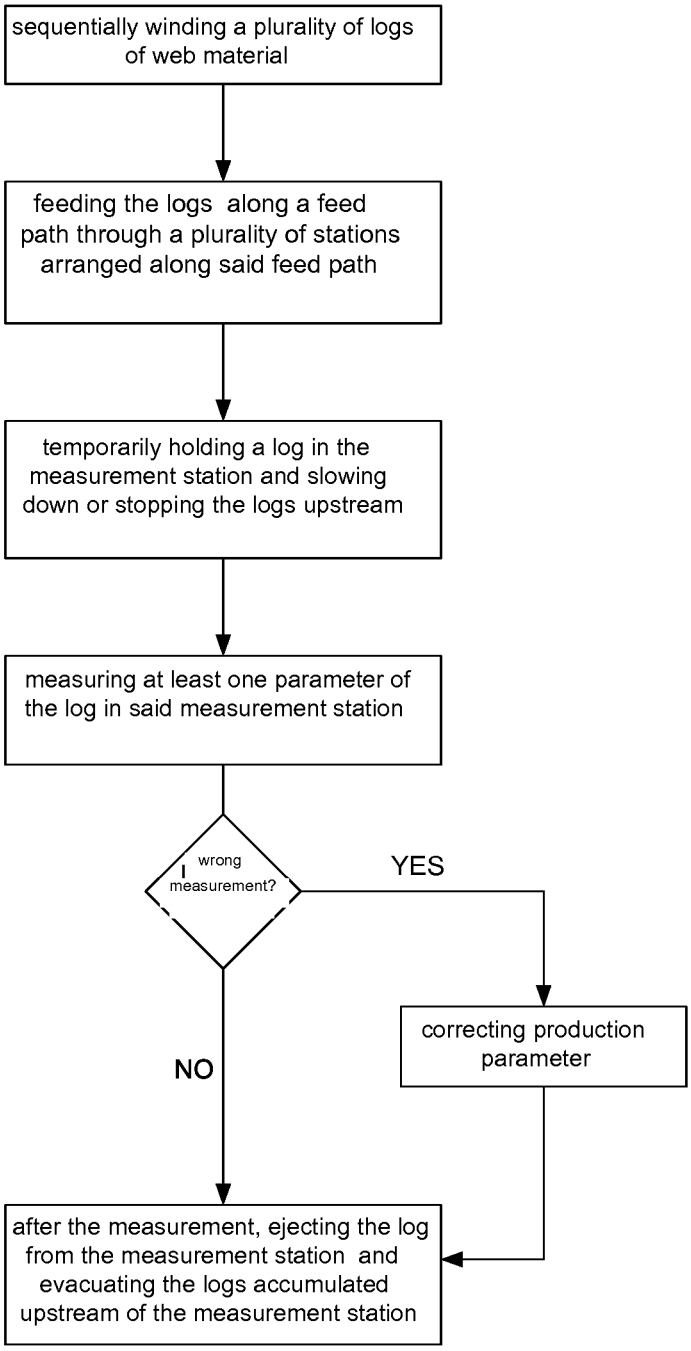
FIG. 16 is a flow chart summarizing a further method according to the present invention.

FIG. 16 is a flowchart summarizing a method executed with a line 1 as in FIG. 15, having the measurement station 11 along the feed path of the logs R and any temporary accumulation or slowing down of the logs upstream of the measurement station.

The temporary accumulation device 121 may consist of a storage integrally arranged upstream of the measurement station 11. In this case, the logs accumulate in the temporary accumulation device 121. When the log temporarily stopped in the measurement station is released and continues to move towards the severing machine 12, for example, the logs accumulated in the accumulation device 121 can be gradually discharged therefrom to continue their forward movement along the feed path. In other embodiments, the temporary accumulation device can form a by-pass path of the measurement station 11. In this case, the entrance of the temporary accumulation device 121 is arranged upstream of the measurement station, whilst the exit of the temporary accumulation device 121 is arranged downstream of the measurement station 11 with respect to the feed path of the logs. Logs entering the temporary accumulation device 121 upstream of the measurement station 11 are gradually discharged from the temporary accumulation device 121 downstream of the measurement station 11. Discharging of the logs from the temporary accumulation device 121 can initiate while the measurement is still going on, for instance if the measurement time so requires, i.e. if the measurement time is so long that the temporary accumulation device 121 is totally filled.

The invention claimed is:

1. A method for producing logs of web material, comprising steps as follows:

sequentially winding a plurality of logs of web material;

feeding the logs along a feed path through a plurality of stations arranged along the feed path;

randomly taking single logs from the feed path and transferring each of said single logs taken from the feed path to a measurement station associated with the feed path by automatically deviating the single logs from the feed path to a measurement path; said measurement station being arranged outside the feed path;

measuring at least one parameter of each of the single logs transferred to the measurement station;

after having performed said measuring of said at least one parameter, transferring each of the single logs from the measurement station to the feed path.

2. The method of claim 1, wherein the logs move forward along the feed path in a direction orthogonal to a log winding axis.

3. The method of claim 1, further comprising cutting each of the logs into a plurality of small rolls, and wherein said measuring of said at least one parameter of each of the single logs transferred to the measurement station is performed before cutting a log of said single logs into single small rolls, so that each of said single logs coming from the measurement station is then subdivided into a plurality of small rolls in a severing machine arranged along the feed path downstream of a rewinder where said logs are wound.

4. The method of claim 1, wherein said at least one parameter is selected from one or more of weight of the log, firmness of the log, diameter of the log, embossing profile of the log; or a combination thereof.

5. The method of claim 1, wherein the single logs are taken from the feed path downstream of a rewinder that has formed the logs, and are inserted again in the feed path upstream of a severing machine where the logs are cut into small rolls.

6. The method of claim 1, wherein said transferring of each of the single logs from the measurement station to the feed path comprises automatically discharging each of the single logs from the measurement station towards the feed path.

7. The method of claim 1, wherein taking the single logs from the feed path comprises temporarily introducing an abutment in the feed path; stopping each of the single logs against the abutment; and removing from the feed path each of the single logs stopped against the abutment.

8. The method of claim 7, wherein said removing of each of the single logs from the feed path comprises lifting each of the single logs from the feed path; the measurement station being arranged above a portion of the feed path.

9. The method of claim 1, wherein transferring each of the single logs from the measurement station to the feed path comprises inserting each of the single logs again in the feed path at a greater height than that where each of the single logs have been taken from the feed path.

10. The method of claim 1, wherein transferring each of the single logs from the measurement station to the feed path comprises inserting each of the single logs in a conveyor movable along the feed path.

11. The method of claim 1, wherein taking the single logs from the feed path is performed after a step of sealing a tail of the log.

12. The method of claim 1, wherein transferring each of the single logs from the measurement station to the feed path comprises introducing each of the single logs in an accumulator arranged in the feed path.

13. The method of claim 1, further comprising modifying at least one operational parameter of the log production according to said at least one parameter measured of a taken log when value of the at least one parameter measured is outside a tolerance range.

14. The method of claim 1, comprising generating a signal by a control unit upon occurrence of at least one condition selected from a measured parameter differing from a desired value by a non-allowable amount, a difference between a measured parameter and a desired value cannot be corrected by changing one or more operational parameters of the log production, and a previous change in at least one operational parameter of the log production has not brought the parameter measured within a tolerance range.

15. A method for producing logs of web material, comprising steps as follows:

sequentially winding a plurality of logs of web material;

feeding the logs along a feed path through a plurality of stations arranged along the feed path; wherein the logs move forward along the feed path in a direction orthogonal to a log winding axis;

measuring at least one parameter of a randomly selected log transferred to a measurement station associated with the feed path and arranged along said feed path by temporarily holding the randomly selected log in the measurement station to perform said measuring of said at least one parameter thereof;

the method further comprising steps of:

slowing down or temporarily stopping flow of the logs upstream of the measurement station while performing said measuring of said at least one parameter of the randomly selected log kept in the measurement station; and when said measuring of said at least one parameter has been performed, ejecting the randomly selected log from the measurement station and accelerating the logs in the feed path upstream of the measurement station to evacuate the logs temporarily slowed down or accumulated upstream of the measurement station; or while performing said measuring of said at least one parameter on the randomly selected log kept in the measurement station, moving the logs arriving upstream of the measurement station in a by-pass path, to move past the measurement station.

16. A line for producing logs of web material, comprising a rewinder, a feed path for the logs from the rewinder towards at least one station arranged downstream of the rewinder; a measurement station comprising at least one measurement device for measuring at least one parameter of logs randomly selected from the feed path and held in the measurement station, wherein the measurement station is arranged outside the feed path; and first transferring members adapted to automatically deviate selected logs from the feed path towards the measurement station and transfer the selected logs from the feed path to the measurement station; and second transferring members adapted to automatically discharge the selected logs from the measurement station towards the feed path and transfer the selected logs from the measurement station to the feed path.

17. The line of claim 16, wherein said at least one station arranged downstream of the rewinder comprises a severing machine adapted to cut the logs into small logs; wherein the measurement station is adapted to receive the selected logs from the feed path between the rewinder and the severing machine; and wherein between the rewinder and the severing machine, the feed path is adapted to move the selected logs forward orthogonally to a winding axis thereof.

18. The line of claim 16, wherein the at least one measurement device comprises at least one of a device for measuring weight of the selected logs; a device for measuring firmness of the selected logs; a device for measuring diameter of the selected logs; a device for measuring embossing profile of the selected logs; or a combination thereof.

19. The line of claim 16, further comprising a tail sealing machine for sealing a tail of the logs, arranged along the feed path downstream of the rewinder; wherein the measurement station is adapted to receive logs after the logs have passed through the tail sealing machine.

20. The line of claim 19, wherein the first transferring members are adapted to take the logs from the feed path downstream of the tail sealing machine.

21. The line of claim 16, further comprising a log accumulator, wherein the second transferring members are adapted to transfer the logs from the measurement station to an accumulator; wherein the feed path extends between the tail sealing machine and the accumulator.

22. The line of claim 16, wherein the measurement station is arranged above the feed path.

23. The line of claim 16, wherein the first transferring members comprise an elevator adapted to selectively take logs from the feed path and to transfer the logs to the measurement station.

24. The line of claim 23, wherein the elevator comprises movable abutments adapted to stop the logs to be taken along the feed path.

25. The line of claim 16, wherein the second transferring members comprise a chute adapted to transfer the logs from the measurement station towards the feed path.

26. The line of claim 16, wherein the measurement station comprises a seat for the logs, which is associated with said at least one measurement device.

27. The line of claim 26, wherein said at least one measurement device is arranged above the seat or at one side of the seat.

28. The line of claim 27, wherein load cells are associated with the seat for measuring weight of a log.

29. The line of claim 26, wherein firmness measuring members, arranged above said seat, are associated with said seat.

30. The line of claim 16, wherein the measurement station comprises at least one of a retractable abutment adapted to arrange the logs in a measurement position; an ejector for ejecting the logs from the measurement station.

31. The line of claim 16, wherein the measurement station comprises at least a control unit adapted to modify at least one production parameter of the line when at least one measurement of the log performed by the measurement device is outside a set range.

32. The line of claim 16, further comprising generating an alarm when changes or a combination of changes in operational parameters do not correct the at least one parameter of the logs measured or when required changes cannot be done by the production line or when the at least one parameter measured differs from a target value of the parameter by more than 5%.

33. A line for producing logs of web material comprising:

a rewinder;

a feed path for the logs from the rewinder to at least one station downstream of the rewinder, along said feed path a measurement station being arranged, comprising at least one measurement device for measuring at least one parameter of randomly taken logs;

a temporary accumulation or deviation device for the logs fed along the feed path while a log is in the measurement station;

wherein the temporary accumulation or deviation device is adapted to temporarily store the logs until the measurement on the logs in the measurement station is finished and/or to temporarily deviate the logs with respect to the measurement station and to insert the logs again in the feed path downstream of the measurement station temporarily occupied by a randomly taken log on which measurements are performed.

* * * * *